US005552866A

United States Patent [19]

Matsumoto et al.

[11] Patent Number: 5,552,866

[45] Date of Patent: Sep. 3, 1996

[54] COPYING APPARATUS FOR THE PHOTOGRAPHIC REPRODUCTION OF A MULTI-DIMENSIONAL OBJECT

[75] Inventors: Fumio Matsumoto; Ryoichi Kato, both of Tokyo; Kazumi Tanabe, Kanagawa; Teruo Bando, Tokyo, all of Japan

[73] Assignee: Fuji Photo Film Co., Ltd., Kanagawa, Japan

[21] Appl. No.: 188,236

[22] Filed: Jan. 28, 1994

[30] Foreign Application Priority Data

Jan. 29, 1993 [JP] Japan ..... 5-013202
May 31, 1993 [JP] Japan ..... 5-129365

[51] Int. Cl.[6] ..... G03G 15/28

[52] U.S. Cl. ..... 355/233; 355/70

[58] Field of Search ..... 355/228, 229, 355/230, 231, 233, 75, 67, 70

[56] References Cited

U.S. PATENT DOCUMENTS

| | | | |
|---|---|---|---|
| 3,997,265 | 12/1976 | Menon et al. | 355/75 |
| 4,043,662 | 8/1977 | Garfall | 355/70 X |
| 4,080,058 | 3/1978 | Stephany et al. | 355/228 X |
| 4,110,041 | 8/1978 | Luperti et al. | 355/75 |
| 4,199,251 | 4/1980 | Zimmet | 355/75 X |
| 4,360,265 | 11/1982 | Lewis | 355/75 X |
| 4,390,267 | 6/1983 | Minor | 355/67 X |
| 4,436,407 | 3/1984 | Satomi et al. | 355/233 X |
| 4,860,060 | 8/1989 | Wise et al. | 355/233 X |
| 5,247,330 | 9/1993 | Ohyama et al. | 355/75 X |

FOREIGN PATENT DOCUMENTS 2-157837 6/1990 Japan .

*Primary Examiner*—Arthur T. Grimley
*Assistant Examiner*—Shuk Y. Lee
*Attorney, Agent, or Firm*—Sughrue, Mion, Zinn, Macpeak & Seas

[57] ABSTRACT

A copying apparatus for the photographic reproduction of a multi-dimensional object capable of photocopying an original and a three-dimensional object, wherein one of an original and a three-dimensional object is disposed on a platen glass, and an illuminating device is disposed so as to be separated from a surface of the platen glass by a predetermined distance in a substantially vertical direction. The illuminating device is also disposed such that the one of the original and the three-dimensional object is positioned between the illuminating device and the platen glass, illuminates a light field to the one of the original and the three-dimensional object. As a result, even if the one of the original and the three-dimensional object is copied onto a photosensitive material, recording can be effected such that quality of a recorded image is maintained and a background image of a copied one of the original and the three-dimensional object is set by the illuminating device.

22 Claims, 29 Drawing Sheets

COPYING APPARATUS FOR THE PHOTOGRAPHIC REPRODUCTION OF A MULTI-DIMENSIONAL OBJECT

BACKGROUND OF THE INVENTION

1. Field of the Invention

The present invention relates to a copying apparatus, and in particular, to a copying apparatus in which an original and a three-dimensional object disposed on a platen glass can be copied.

2. Description of the Related Art

In a copying apparatus, in which light is illuminated onto an object to be copied which is disposed on a platen glass and the reflected light is exposed onto an image recording material (photosensitive material) so that copying (image recording) is effected, the exposure device is formed by a light source, a reflecting mirror and a plurality of lenses. In this type of copying apparatus, the object to be copied which is disposed on the platen glass is covered by a platen cover. Light from the light source is illuminated onto the covered object to be copied. Among the illuminated light, the light which was reflected by the object to be copied is exposed onto an image recording material so that an image is recorded. Accordingly, even if the object to be copied which is disposed on the platen glass is a three-dimensional object, the depth of the object can be copied to a certain extent.

However, when a three-dimensional object is copied by such a copying apparatus, the three-dimensional object disposed on the platen glass cannot be sufficiently covered by the platen cover. Therefore, on the recorded image, the background of the object to be copied is black. There is therefore room for improvement of the apparatus with respect to this point.

In this case, even if the three-dimensional object disposed on the platen glass is covered by a cloth or the like, the shadows of the cloth are recorded irregularly. This drawback is particularly noticeable in the copying of printed boards or in the copying of internal organs or the like in the medical field in which high-quality images are required.

A structure has been proposed in which a light box using a plurality of high-luminance lamps is used as a simple backlight, and the surface of the platen glass is illuminated by light in planar form. However, an extremely large amount of power is required, and the system is difficult to manage. Further, there are adverse effects due to the generation of heat (which presents a great problem when easily deformable objects, such as living organisms and the like, are copied). Therefore, this system as well did not result in a fundamental solution.

SUMMARY OF THE INVENTION

In view of the aforementioned, an object of the present invention is to provide a copying apparatus in which, even if a three-dimensional object is to be copied, the quality of the recorded image can be maintained and the image can be recorded by setting the background color of the three-dimensional object to be copied as desired without there being an excessive amount of power consumed nor complex workability.

The first aspect of the present invention is a copying apparatus able to copy an original and a three-dimensional object, comprising: a platen glass on which one of the original and the three-dimensional object is disposed; and illuminating means for illuminating light to the one of the original and the three-dimensional object, the illuminating means being disposed so as to be separated from a surface of the platen glass by a predetermined distance in a vertical direction and being disposed such that the one of the original and the three-dimensional object is positioned between the illuminating means and the platen glass.

The second aspect of the present invention is a copying apparatus able to copy an original and a three-dimensional object. In the second aspect, in addition to the first aspect, the illuminating means can also illuminate a transparency original which is disposed on the platen glass. The transparency original is copied by light being transmitted therethrough.

The third aspect of the present invention is a copying apparatus able to copy an original and a three-dimensional object. In the third aspect, in addition to the first and second aspects, the illuminating means has a light amount changing means for changing an amount of light illuminated to the transparency original or to the three-dimensional object.

The fourth aspect of the present invention is a copying apparatus able to copy an original and a three-dimensional object. In the fourth aspect, in addition to the first and second aspects, the illuminating means has a color correction means for changing a color of light illuminated to the transparency original or to the three-dimensional object.

The fifth aspect of the present invention is a copying apparatus able to copy an original and a three-dimensional object, comprising: a platen glass on which one of the original and the three-dimensional object is disposed; a light source disposed such that the platen glass is disposed between the light source and the one of the original and the three-dimensional object, the light source successively illuminating copy light in a slit shape to the one of the original and the three-dimensional object via the platen glass so that the copy light illuminated to the one of the original and the three-dimensional object is reflected by the one of the original and the three-dimensional object and exposed onto a photosensitive material; illuminating means for illuminating the one of the original and the three-dimensional object, the illuminating means being provided so as to be able to be positioned within and separate from a region opposing a surface of the platen glass, and when the illuminating means is positioned within the region, the illuminating means is disposed such that the one of the original and the three-dimensional object is positioned between the platen glass and the illuminating means, and the illuminating means is operated synchronously with the light source and has a linear light source for generating light in a slit shape and successively illuminates the light to the one of the original and the three-dimensional object; and holding means for holding the illuminating means in a state in which the illuminating means is separated from the surface of the platen glass by a predetermined distance in a substantially vertical direction, when the illuminating means is disposed within the region opposing the surface of the platen glass.

The sixth aspect of the present invention is a copying apparatus able to copy an original and a three-dimensional object. In the sixth aspect, in addition to the fifth aspect, the holding means are plurally provided at positions at which contact of the holding means and the one of the original and the three-dimensional object, which is disposed on the platen glass, is prevented when the illuminating means moves from a state of being disposed within the region opposing the surface of the platen glass, and at which placement of the one of the original and the three-dimensional object on the platen glass is facilitated when the illuminating means is disposed within the region opposing the surface of the platen glass.

The seventh aspect of the present invention is a copying apparatus able to copy an original and a three-dimensional object. In the seventh aspect, in addition to the fifth and sixth aspects, the illuminating means has a light amount changing means for changing an amount of light illuminated to the one of the original and the three-dimensional object.

The eighth aspect of the present invention is a copying apparatus able to copy an original and a three-dimensional object. In the eighth aspect, in addition to the fifth and sixth aspects, the illuminating means has a color correction means for changing a color of light illuminated to the one of the original and the three-dimensional object.

The ninth aspect of the present invention is a copying apparatus able to copy an original and a three-dimensional object. In the ninth aspect, in addition to the fifth, sixth, seventh and eighth aspects, the copying apparatus further comprises: a supplemental information recording member, when the illuminating means is in an operating state in which the illuminating means illuminates the one of the original and the three-dimensional object and at all holding positions at which the illuminating means is held by the holding means so as to be separated from the surface of the platen glass, the supplemental information recording member is provided at a predetermined position on the surface of the platen glass and supplemental image information is recorded on a surface of the supplemental information recording member opposing the surface of the platen glass, and the supplemental image information is recorded onto an image recording material by copy light illuminated from the light source being reflected by the supplemental information recording member.

In accordance with the first aspect of the present invention, light is illuminated by the illuminating means to the back surface of the one of the original and the three-dimensional object disposed on the platen glass (i.e., to the surface of the one of the original and the three-dimensional object which is opposite to the surface thereof which faces the platen glass). In this way, the background of the one of the original and the three-dimensional object is exposed and recorded by light illuminated from the illuminating means. Namely, on the recorded (more specifically, copied) image, the image of the one of the original and the three-dimensional object is exposed and recorded, and the background image of the one of the original and the three-dimensional object is exposed and recorded at a predetermined color (e.g., white).

Even if one of an original and a three-dimensional object is copied, the image thereof can be recorded such that the quality of the recorded image is maintained and the background color of the copied one of the original and the three-dimensional object is set by the illuminating means as desired.

In accordance with the second aspect of the present invention, the illuminating means can record an image of a transparency original which is copied onto a photosensitive material by light being transmitted therethrough. Namely, when the transparency original to be copied is disposed on the platen glass, light from the illuminating means is illuminated from the surface onto the transparency original, which is disposed on the platen glass, so that the image of the transparency original can be recorded onto the photosensitive material. In this way, exposure can be effected with the background color of the three-dimensional object set as desired. Further, even if the transparency original is disposed on the platen glass, the image of the transparency original can be recorded.

In accordance with the third aspect of the present invention, the amount of light illuminated from the illuminating means can be changed as desired by the light amount changing means, and the light is illuminated. Accordingly, the background image of a transparency original to be copied or a three-dimensional object to be copied can be exposed and recorded at a desired amount of light.

In accordance with the fourth aspect of the present invention, the color of the light illuminated from the illuminating means can be changed as desired by the color correction means, and the light is illuminated. Accordingly, the background image of a transparency original to be copied or a three-dimensional object to be copied can be exposed and recorded in white or any other desired color.

In accordance with tile fifth aspect of the present invention, when copying is effected, the illuminating means is positioned in a region opposing the surface of the platen glass and is held by the holding means in a state of being separated from the surface of the platen glass by a predetermined distance in the substantially vertical direction.

Here, the one of the original and the three-dimensional object is inserted between the illuminating means and the platen glass and is disposed on the platen glass. Next, the light source is operated, and the illuminating means is operated synchronously with the light source. Light from the light source is illuminated successively in a slit shape to the one of the original and the three-dimensional object which is disposed on the platen glass. Light is successively and synchronously illuminated in a slit shape by the illuminating means to the back surface of the one of the original and the three-dimensional object. Accordingly, an image is exposed and recorded onto the photosensitive material by the light reflected from the one of the original and the three-dimensional object, and the background is exposed and recorded by the light illuminated from the illuminating means.

In this way, on the recorded (more specifically, copied) image, the image of the one of the original and the three-dimensional object is exposed and recorded, and the background thereof is exposed and recorded at a predetermined color (e.g., white).

When one of an original and a three-dimensional object is copied, the image can be recorded such that the quality of the recorded image is maintained and the background color of the copied one of the original and the three-dimensional object is set by the illuminating means as desired.

Because the illuminating means illuminates light in a slit shape, there is no need for a large amount of electric power as compared with a case in which light is illuminated in planar form. Further, there are no adverse effects due to the generation of heat.

In accordance with the sixth aspect of the present invention, the holding means are plurally provided at positions at which contact of the holding means and the one of the original and the three-dimensional object, which is disposed on the platen glass, is prevented when the illuminating means moves from a state of being disposed within the region opposing the surface of the platen glass, and at which placement of the one of the original and the three-dimensional object on the platen glass is facilitated when the illuminating means is disposed within the region opposing the surface of the platen glass. Accordingly, when the illuminating means is positioned at or separated from a position opposing the surface of the platen glass, the other two sides are not obstructive. Further, the illuminating means is held by the holding means in a state in which the illuminating means is separated from the platen glass by a predetermined distance in an upward direction. Even when the one of the original and the three-dimensional object is inserted between the illuminating means and the platen glass, the other two sides are not obstructive, and the one of the original and the three-dimensional object can easily be inserted between the illuminating means and the platen glass and disposed on the platen glass.

In accordance with the seventh aspect of the present invention, the amount of light illuminated from the illuminating means can be changed as desired by the light amount changing means, and the light is illuminated. Accordingly, the background image of the copied original or the copied three-dimensional object can be exposed and recorded at a desired amount of light.

In accordance with the eighth aspect of the present invention, the color of the light illuminated from the illuminating means can be changed as desired by the color correction means, and the light is illuminated. Accordingly, the background image of the copied original or the copied three-dimensional object can be exposed and recorded in white or any other desired color.

In accordance with the ninth aspect of the present invention, when the illuminating means is in an operated state, regardless of the position at which the illuminating means is held, the supplemental information recording member is positioned at a predetermined place on the surface of the platen glass. Therefore, the light illuminated from the illuminating means is not directly exposed, and the light illuminated from the light source is reflected and exposed.

If, for example, a scale, a color chart, a name plate or the like is used as the supplemental information recording member, various types of supplemental image information can be recorded on the recorded image.

DESCRIPTION OF THE PREFERRED EMBODIMENTS

Figure 1:
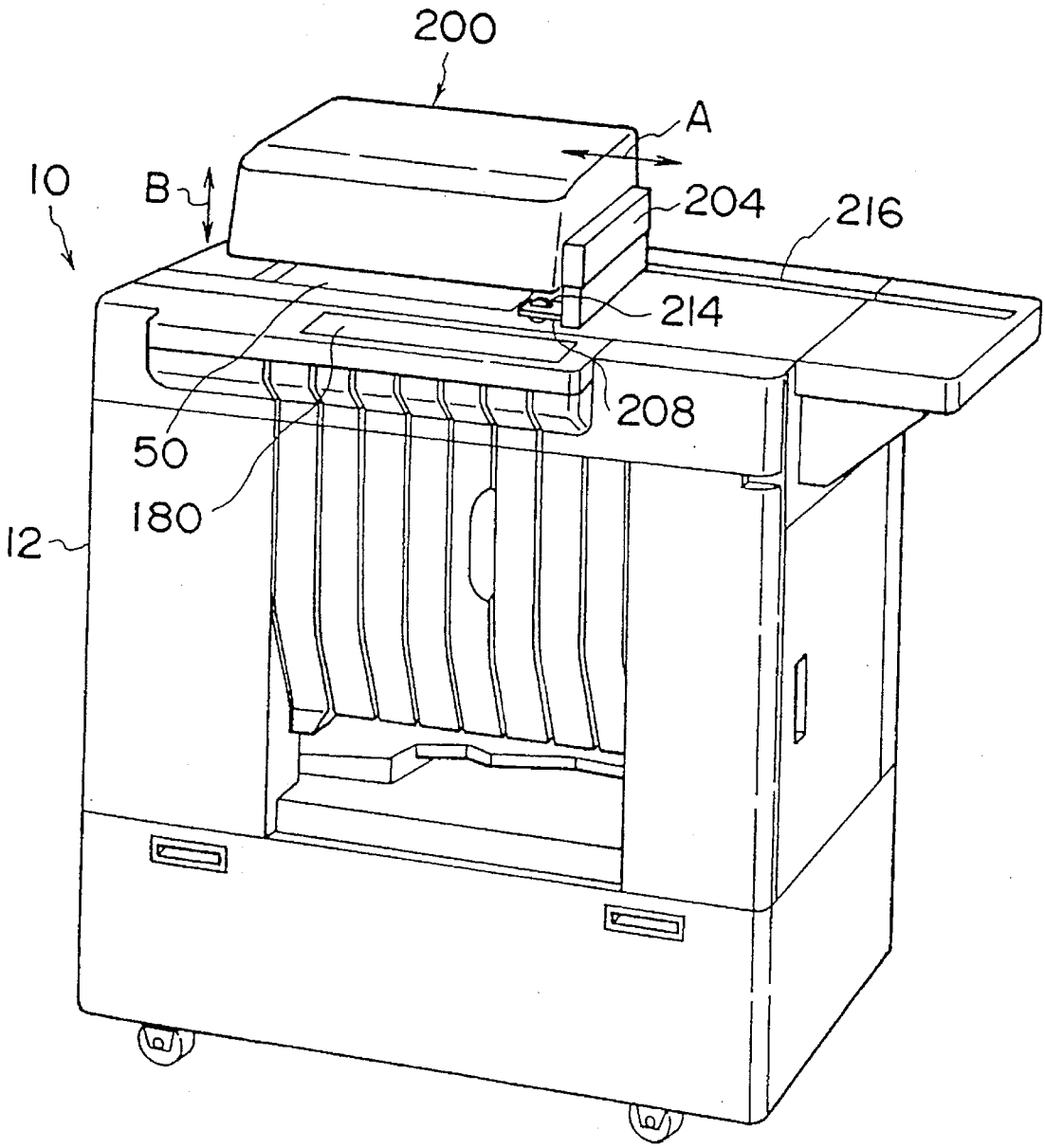
FIG. 1 is an overall external view illustrating a copying apparatus relating to a first embodiment of the present invention.
Figure 2:
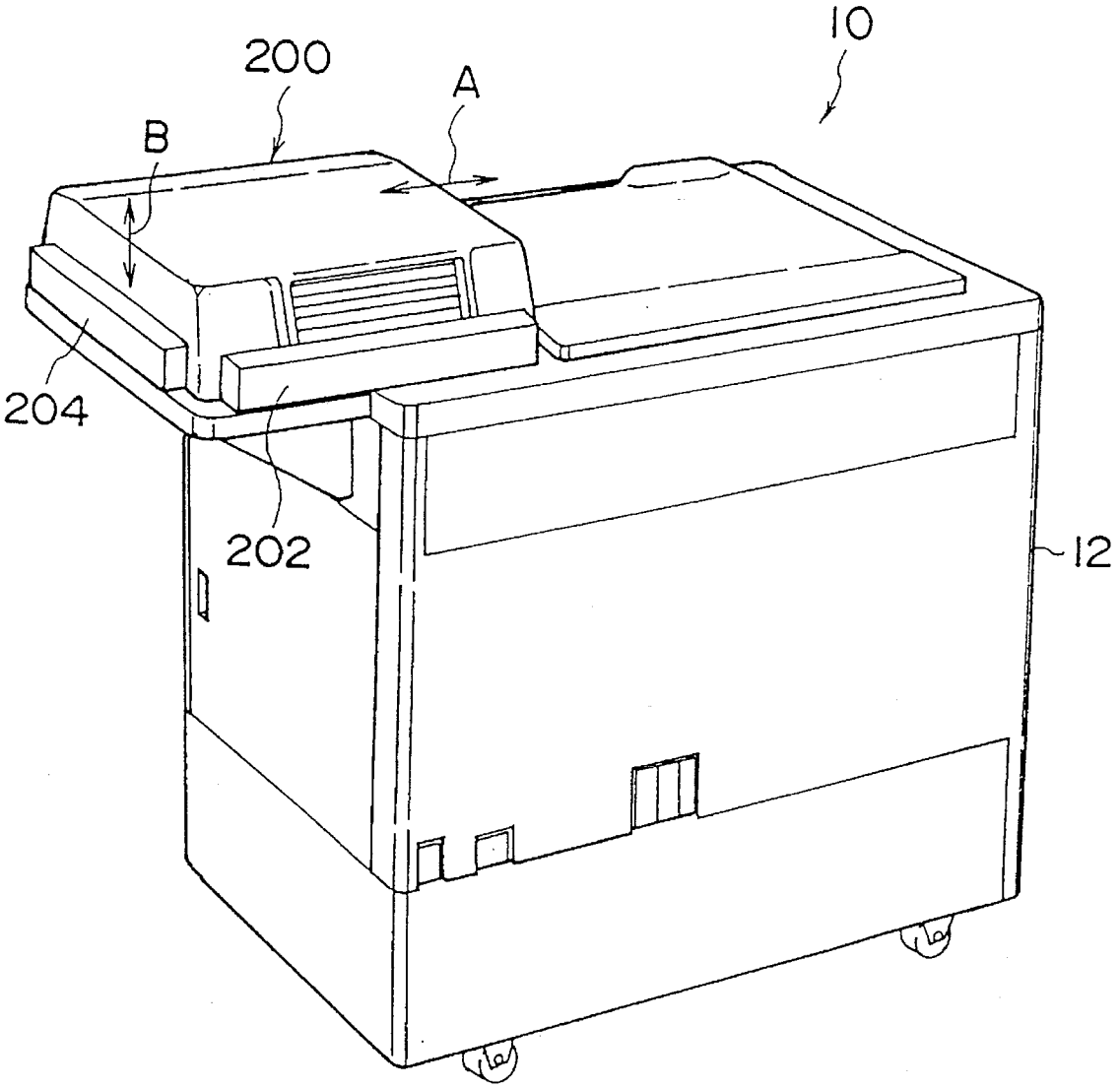
FIG. 2 is an overall external view as seen from a rear surface side of the copying apparatus relating to the first embodiment of the present invention.
Figure 3:
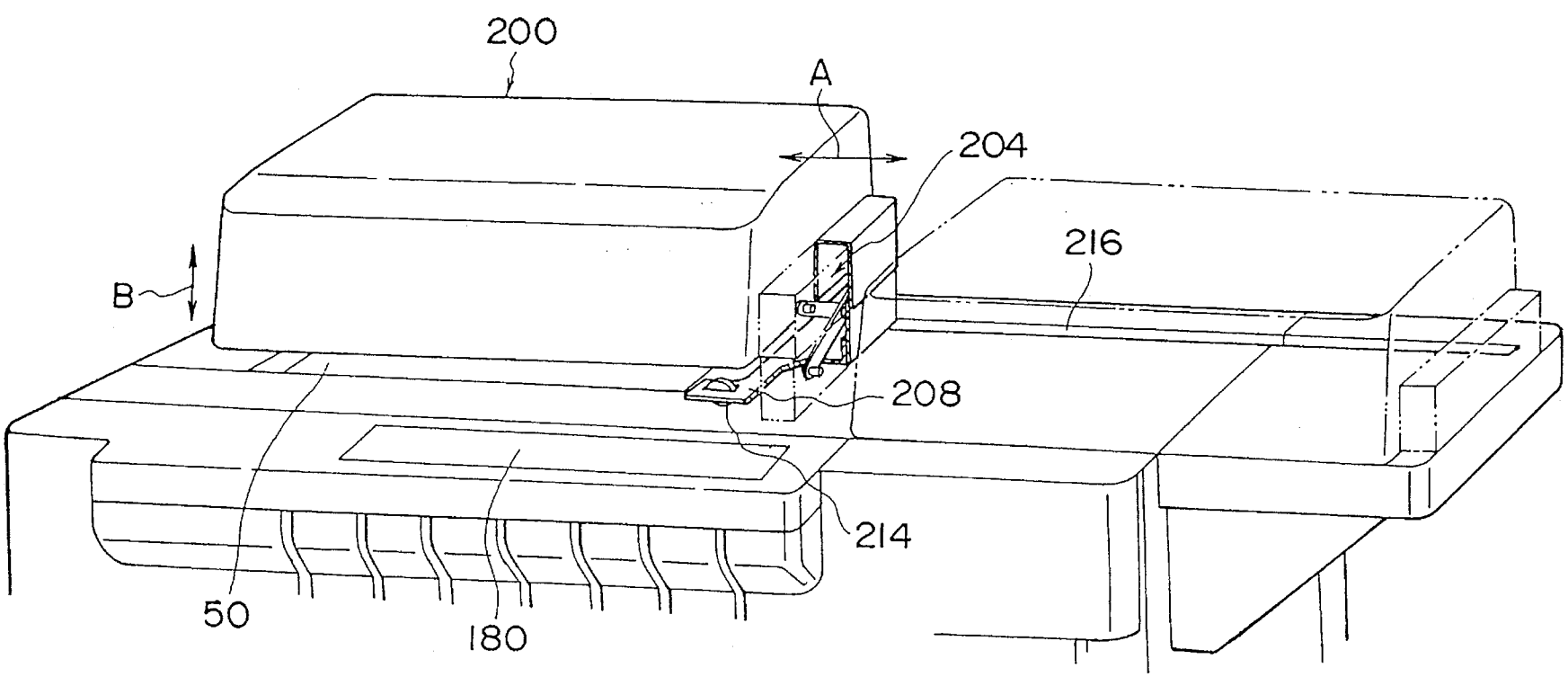
FIG. 3 is a perspective view illustrating states in which a proof unit is disposed.

An overall external view of a copying apparatus 10 relating to a first embodiment of the present invention is illustrated in FIG. 1. FIG. 2 illustrates an overall external view of the copying apparatus 10 as seen from a rear surface side thereof. FIG. 3 is a perspective view of main portions of the copying apparatus 10, and FIG. 4 illustrates schematic structural view of the copying apparatus 10.

Figure 4:
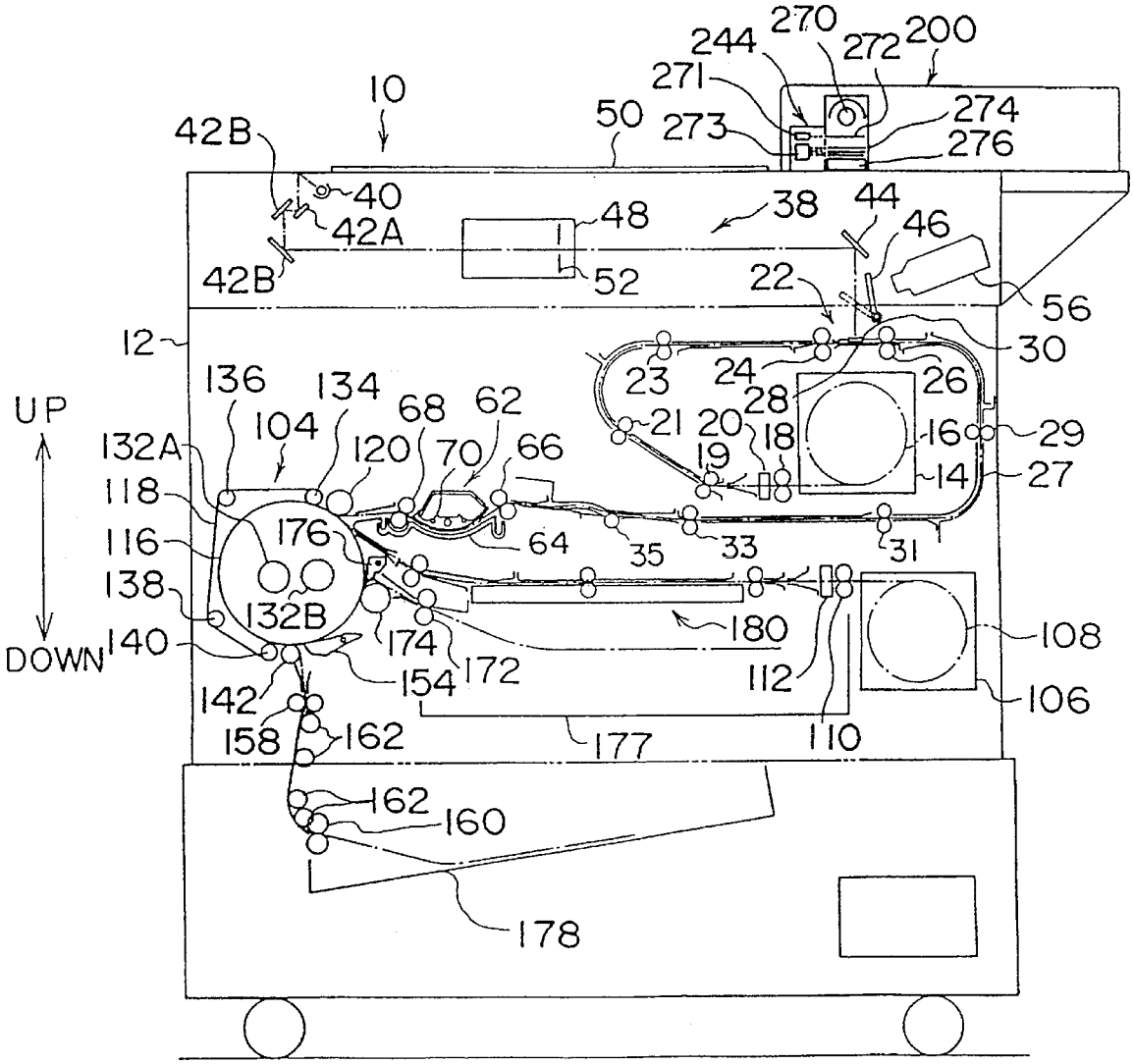
FIG. 4 is a schematic structural view of the copying apparatus relating to the first embodiment of the present invention.

As illustrated in FIG. 4, a photosensitive material magazine 14 is disposed within a machine stand 12 of the copying apparatus 10 which is structured, on the whole, in a box-shape. A photosensitive material 16 is wound in roll form and is accommodated within the photosensitive material magazine 14. Nip rollers 18 and a cutter 20 are disposed in a vicinity of a photosensitive material removal opening of the photosensitive material magazine 14 so that the photosensitive material 16 can be cut after a predetermined length thereof has been pulled out from the photosensitive material magazine 14.

A plurality of conveying rollers 19, 21, 23, 24, 26, 29, 31, 33, 35 and a guide 27 are disposed in a vicinity of the cutter 20 and the photosensitive material magazine 14 and form a conveying path so that the photosensitive material 16 cut to the predetermined length can be conveyed to an exposure section 22.

The exposure section 22 which exposes the photosensitive material 16 is disposed above the photosensitive material magazine 14 and on the conveying path of the photosensitive material 16. The exposure section 22 is positioned between the conveying rollers 24 and the conveying rollers 26 so as to form an exposure portion (exposure point) which is between these conveying rollers and through which the photosensitive material 16 passes. Further, a guide plate 28 is disposed between these conveying rollers, and an exposure surface glass 30 is disposed above the conveying path of the photosensitive material 16. The photosensitive material 16 passes between both sets of conveying rollers (the exposure section) while being made flat (while deformation thereof is corrected) by the guide plate 28 and the exposure surface glass 30.

An exposure device 38 is provided directly above the exposure section 22. A light source 40, a moving mirror 42A, a moving mirror 42B, a fixed mirror 44, a reflection mirror 46, and a lens unit 48 are disposed in the exposure device 38. Further, a platen glass 50, which serves as an original holding plate, is provided above these parts in an upper portion of the machine stand 12.

The lens unit 48 is formed of a group of lenses (e.g., six lenses), and a color correcting filter (i.e., a CC filter) is built therein. A movable-type aperture slit plate 52 is disposed at the downstream side (the fixed mirror 44 side) of the optical path of the lens unit 48.

The amounts of movement of the light source 40, the moving mirrors 42A, 42B and the lens unit 48 along the surface of the platen glass 50 can be varied in accordance with variations in the copying magnification for copying onto the photosensitive material 16. Light is illuminated onto an original disposed on the platen glass 50, and the reflected image light (image light) is scanned and exposed, via the fixed mirror 44, onto the photosensitive material 16 positioned at the exposure section 22. In this case, the speed of movement of the moving mirror 42B is one-half of the speeds of movement of the light source 40 and the moving mirror 42A.

The reflection mirror 46 is disposed so as to be able to be set on and separated from the optical path of the image light illuminated to the exposure section 22 via the moving mirrors 42A, 42B and the fixed mirror 44. Namely, the reflection mirror 46 is usually set on the optical path of the image light so that light illuminated via the moving mirrors 42A, 42B and the fixed mirror 44 is reflected in a substantially orthogonal direction. On the other hand, when the image of the original is scanned and exposed onto the photosensitive material 16 disposed at the exposure section 22, the reflection mirror 46 is removed from the optical path so that the image can be exposed onto the photosensitive material 16. When the reflection mirror 46 is set on the optical path of the image light, the reflected light enters a light detecting sensor 56.

The light detecting sensor 56 includes sensor heads which are able to detect two types of wavelengths for blue, green and red, i.e., a total of six sensor heads, and is connected to an unillustrated control device. The light detecting sensor 56 measures the image density of the image of the original, and sets the exposure conditions of the color correcting filter (CC filter) and the aperture slit plate 52 on the basis of the measured value.

A water application section 62 is disposed at the final end of the substantially circular conveying path of the photosensitive material 16 which is formed so as to encircle the periphery of the photosensitive material magazine 14 and pass therebelow. After the photosensitive material 16, on which an image was exposed at the exposure section 22, is conveyed around the periphery of the photosensitive material magazine 14, the photosensitive material 16 is conveyed by the conveying rollers 29, 31, 33, 35 and is guided by the guide plate 27 so as to be delivered into the water applying section 62.

An application tank 64 is disposed in the water applying section 62. A pair of supply rollers 66 is disposed at the end portion of the application tank 64 which is at the upstream side in the direction of conveying of the photosensitive material 16. Further, a pair of squeeze rollers 68 is disposed at the end portion of the application tank 64 which is at the downstream side in the conveying direction of the photosensitive material 16. A guide plate 70 is mounted above the application tank 64 so as to oppose the application tank 64. A space through which the photosensitive material 16 passes is formed between the guide plate 70 and the application tank 64. Accordingly, when the application tank 64 is filled with water, water is applied to the photosensitive material 16 which is conveyed into the space between the guide plate 70 and the application tank 64 by the supply rollers 66. Further, excess water is removed from the photosensitive material 16 by the photosensitive material 16 being nipped and conveyed by the squeeze rollers 68.

A heat development transfer section 104 is disposed at a side of the water application section 62. The photosensitive material 16 to which water has been applied (i.e., the photosensitive material 16 which has passed through the squeeze rollers 68) is delivered into the heat development transfer section 104.

An image receiving material magazine 106 is disposed beneath the photosensitive material magazine 14 within the machine stand 12. An image receiving material 108 is wound in roll form and accommodated within the image receiving material magazine 106.

A pair of nip rollers 110 is disposed in a vicinity of the image receiving material removal opening of the image receiving material magazine 106. The nip rollers 110 can pull the image receiving material 108 out from the image receiving material magazine 106, and the nipping state of the nip rollers 110 can be released.

A cutter 112 is disposed in a vicinity of the nip rollers 110. The image receiving material 108 pulled out from the image receiving material magazine 106 is cut to a length which is shorter than that of the photosensitive material 16.

The image receiving material 108 which has been cut to a predetermined length is guided by an image receiving material conveying section 180 and is conveyed to the heat development transfer section 104.

The heat development transfer section 104 is formed by a heat drum 116 and an endless pressure-contact belt 118. Further, a laminating roller 120 is disposed at the outer periphery of the heat drum 116 at a portion of the heat drum 116 which is close to the water application section 62.

The photosensitive material 16, which has been conveyed to the heat development transfer section 104, is delivered between the laminating roller 120 and the heat drum 116. The conveying of the image receiving material 108 is synchronized to the conveying of the photosensitive material 16 such that, with the photosensitive material 16 preceding the image receiving material 108 by a predetermined length, the image receiving material 108 is delivered between the laminating roller 120 and the heat drum 116 so as to be superposed with the photosensitive material 16.

A pair of halogen lamps 132A, 132B are disposed within the heat drum 116 and can raise the temperature of the surface of the heat drum 116.

The endless pressure-contact belt 118 which presses the photosensitive material 16 and the image receiving material 108 into contact with the outer circumference of the heat drum 116 is trained around four training rollers 134, 136, 138, 140. The outer side of the endless pressure-contact belt 118 disposed between the training roller 134 and the training roller 140 is pressed into contact with the outer periphery of the heat drum 116. The training roller 140 is connected to an unillustrated drum motor whose driving force is transmitted to the training roller 140 so as to rotate the training roller 140. The endless pressure-contact belt 118 is rotated in accordance with the rotation of the training roller 140. The driving force of the endless pressure-contact belt 118 is transmitted to the heat drum 116 by the frictional force between the endless pressure-contact belt 118 and the heat drum 116, so that the rotation of the heat drum 116 follows the rotation of the endless pressure-contact belt 118.

The photosensitive material 16 and the image receiving material 108, which are superposed due to the laminating roller 120, are nipped and conveyed between the heat drum 116 and the endless pressure-contact belt 118 in the superposed state for approximately half of the periphery of the heat drum 116 (i.e., between the training roller 134 and the training roller 140). When the photosensitive material 16 is heated while it is being nipped and conveyed, mobile pigments are emitted. Simultaneously, these pigments are transferred to the pigment fixing layer of the image receiving material 108 so that an image is obtained.

A bending/guiding roller 142 is disposed downstream of the endless pressure-contact belt 118 in the conveying direction of the materials and at a lower portion of the outer periphery of the heat drum 116. The bending/guiding roller 142 is pressed into contact with the outer periphery of the heat drum 116. As a result, the photosensitive material 16 and the image receiving material 108 conveyed by the heat drum 116 and the endless pressure-contact belt 118 can be nipped and conveyed even further.

A peeling claw 154 is disposed downstream of the bending/guiding roller 142 in the conveying direction of the materials and at a lower portion of the outer periphery of the heat drum 116, and is axially supported so as to be pivotable. The peeling claw 154 is provided so as to oppose the outer periphery of the heat drum 116, and is able to move in directions of approaching and moving away from the heat drum 116 due to operation of an unillustrated solenoid. In a state in which the peeling claw 154 abuts the heat drum 116, of the photosensitive material 16 and the image receiving material 108 which are nipped and conveyed between the endless pressure-contact belt 118 and the heat drum 116, the peeling claw 154 engages the leading end portion of only the photosensitive material 16, which is superposed with the image receiving material 108 so as to precede the image receiving material 108 by a predetermined length. Due to the engagement of the peeling claw 154 and the leading end portion of the photosensitive material 16, the photosensitive material 16 can be peeled from the outer periphery of the heat drum 116. Further, the peeled photosensitive material 16 is moved downward while being trained around the bending/guiding roller 142.

Photosensitive material discharge rollers 158, 160 and a plurality of guide rollers 162 are disposed beneath the bending/guiding roller 142 and the peeling claw 154. The photosensitive material 16, which is being conveyed downward while trained around the bending/guiding roller 142, is conveyed further, and is accumulated in a waste photosensitive material accommodating box 178.

A peeling roller 174 and a peeling claw 176 are disposed at the downstream side of the peeling claw 154 in the direction of conveying of the materials and in a vicinity of the outer periphery of the heat drum 116. The peeling roller 174, together with the peeling claw 176, peels the image receiving material 108, which moves together with the heat drum 116, from the outer periphery of the heat drum 116 and bends and guides the image receiving material 108.

An image receiving material discharge roller 172 and a tray 177 are disposed in a vicinity of the peeling roller 174 and the peeling claw 176. The image receiving material 108 peeled from the outer periphery of the heat drum 116 by the peeling claw 176 is conveyed by the image receiving material discharge roller 172 and is discharged to the tray 177.

As illustrated in FIG. 1, an operation panel 180 is disposed at the front surface side of the upper portion of the machine stand 12 of the copying apparatus 10 having the above-described structure (i.e., in a vicinity of the platen glass 50). Various controls can be effected by the operation panel 180.

A proof unit 200, which serves as a transparency original illuminating device (i.e., a device for illuminating an original which is copied by light being transmitted therethrough), is disposed at an upper portion of the machine stand 12 of the copying apparatus 10.

Figure 6:
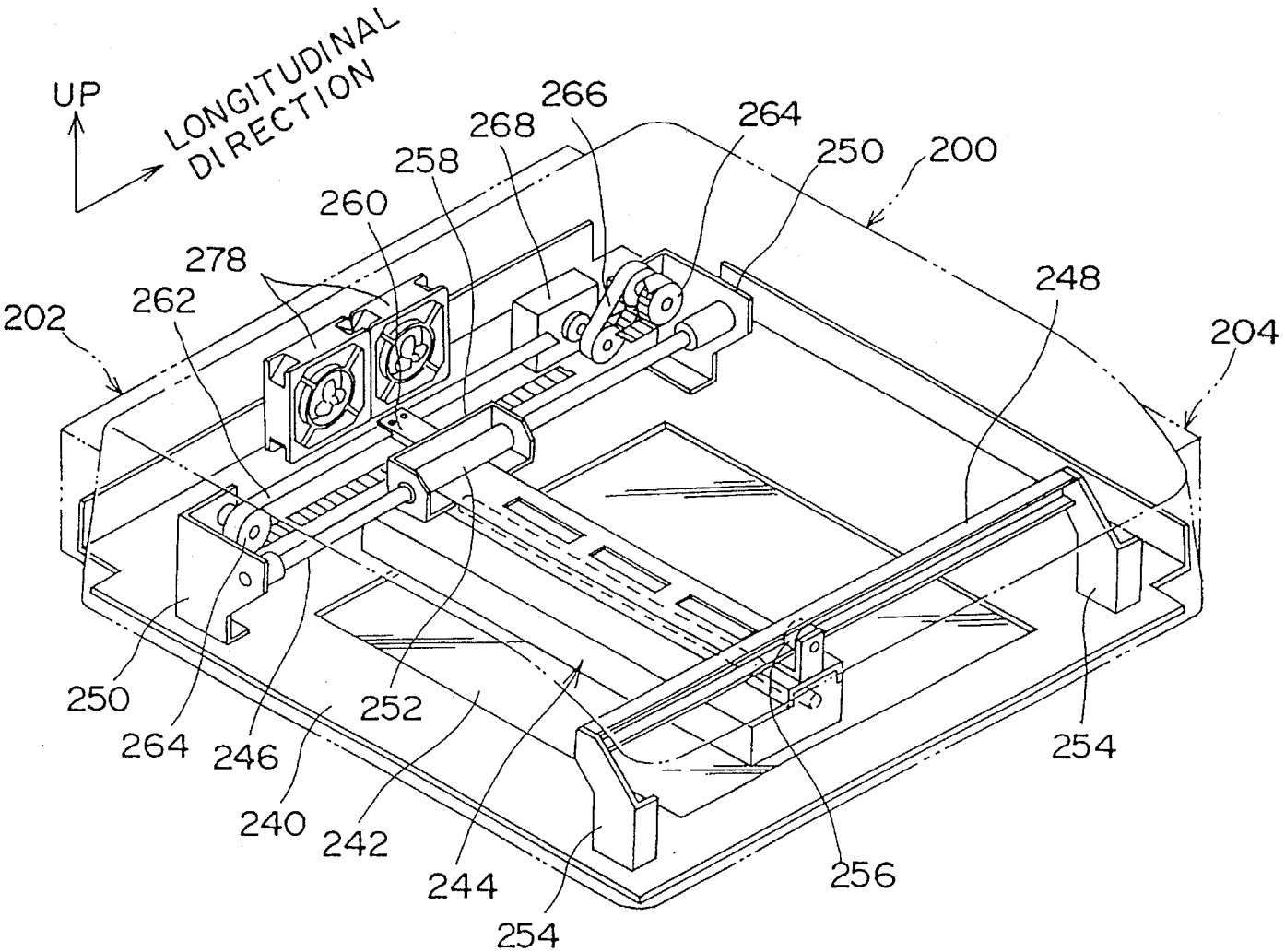
FIG. 6 is a perspective view illustrating an internal structure of the proof unit of the copying apparatus relating to the first embodiment of the present invention.
Figure 7:
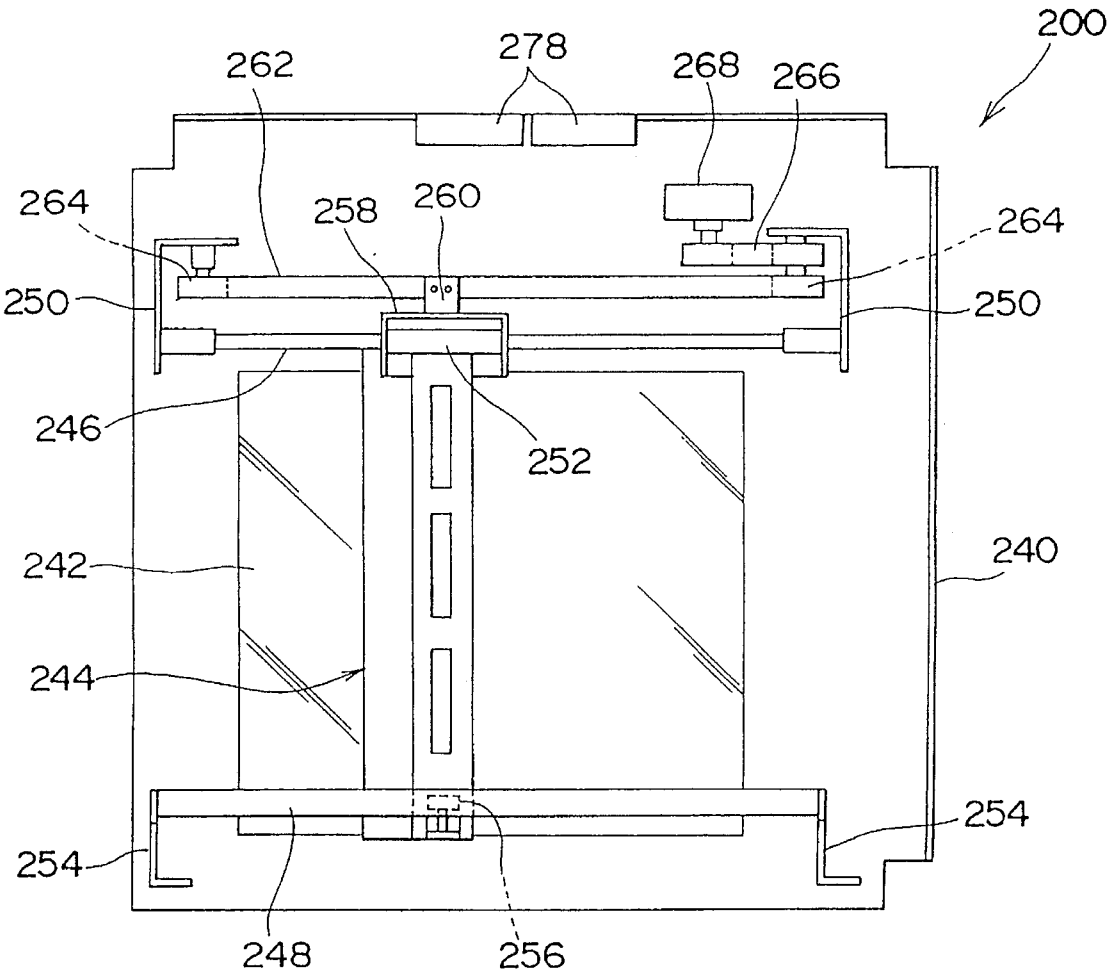
FIG. 7 is a plan view illustrating the internal structure of the proof unit of the copying apparatus relating to the first embodiment of the present invention.

As illustrated in FIGS. 6 and 7, the overall outer configuration of the proof unit 200 is formed as a substantially rectangular parallelopiped box-shape, and a frame 240 is disposed at the interior thereof. The frame 240 is formed in a frame configuration having an opening in the central portion thereof. A glass plate 242 is built into the opening. A lamp unit 244 is disposed above the frame 240. The lamp unit 244 is supported by a guide rod 246 and a guide rail 258, which are mounted along the longitudinal direction of the frame 240, such that the lamp unit 244 is slidable in the longitudinal direction of the frame 240.

The guide rod 246 is fixed to the frame 240 via brackets 250, which are disposed respectively at the longitudinal direction end portions of the guide rod 246. A cylindrical bearing 252 is assembled at one longitudinal direction end portion of the lamp unit 244 such that the guide rod 246 is inserted through the bearing 252. The cross section of the guide rail 248 in a direction orthogonal to the longitudinal direction thereof is substantially rectangular. In the same way as the guide rod 246, the guide rail 248 is fixed to the frame 240 via brackets 254, which are disposed respectively at the longitudinal direction end portions of the guide rail 248. A roller 256, which is mounted to the other longitudinal direction end portion of the lamp unit 244, is fit into the concave portion of the guide rail 248 so as to be slidable in the longitudinal direction. Due to the above-described structure, the lamp unit 244 can be slid along the longitudinal direction of the frame 240 while a predetermined position and a predetermined distance of the lamp unit 244 with respect to the glass plate 242 are maintained.

A bracket 258 is mounted to an end portion of the lamp unit 244. The guide rod 246 penetrates through the bracket 258 at both longitudinal end portions of the bearing 252. A fastener 260 is mounted to the bracket 258, and is connected to a timing belt 262. The timing belt 262 is trained around a pair of rollers 264 such that the longitudinal direction of the timing belt 262 is parallel to the guide rod 246. A motor 268 is connected, via a belt 266, to one of the rollers 264 around which the timing belt 262 is trained. The timing belt 262 is rotated by the driving of the motor 268. Accordingly, due to the rotation of the timing belt 262 by the driving of the motor 268, the fastener 260, i.e., the lamp unit 244, moves together with the timing belt 262 along the guide rod 246.

Figure 5:
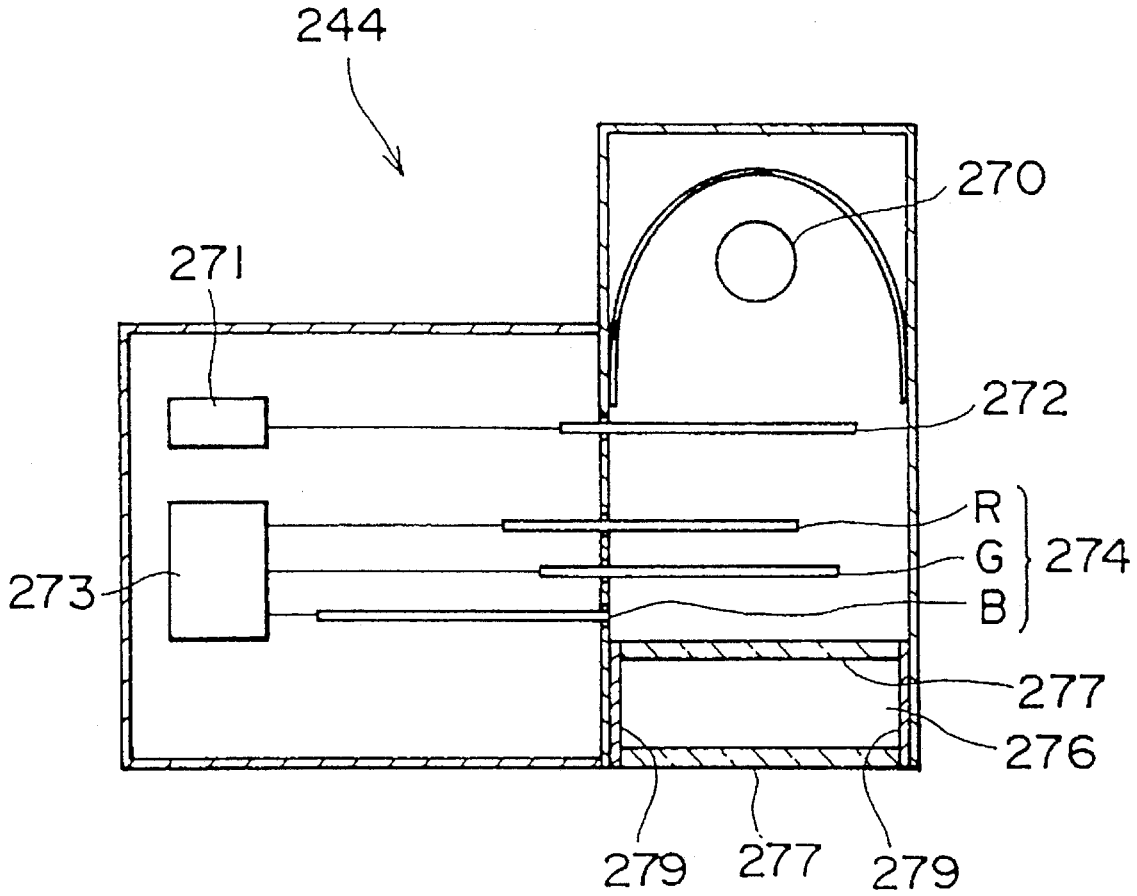
FIG. 5 is a schematic structural view of a lamp unit incorporated in the proof unit of the copying apparatus relating to the first embodiment of the present invention.

FIG. 5 illustrates details of the interior of the lamp unit 244 having the structure described above. A light source 270, an ND filter 272 which changes the amount of light illuminated from the light source 270, a color correcting filter (i.e., a CC filter) 274 of, for example, three colors of red R, green G and blue B which changes the color of the illuminated light, and a diffusion tube 276 are built into the interior of the lamp unit 244.

The light source 270 is formed so as to be long along the axial direction, i.e., in a direction which substantially runs along the longitudinal direction of the lamp unit 244, and can illuminate light in a linear form.

The ND filter 272 is connected to a control unit 271 which includes a pulse motor or the like. The amount of light illuminated from the light source 270 can be changed by the amount of insertion of the ND filter 272 being changed.

Further, the color correcting filter 274 is connected to a control unit 273 which includes a pulse motor or the like. The color of the light illuminated from the light source 270 can be changed by the respective amounts of insertion of the R, G, B filters being changed.

The diffusion tube 276 is provided with diffusion plates 277 at both end portions in the vertical direction of FIG. 5. Mirror surfaces 279 are formed at the interior of the diffusion tube 276 in left and right directions of FIG. 5. Due to the light generated from the light source 270 passing through the diffusion tube 276, uniform light whose amount of light and color have been adjusted is illuminated onto the platen glass 50.

Further, merely the diffusion plates 277 may be used in place of the diffusion tube 276, and a plurality of the ND filters 272 and a plurality of each of the R, G, B filters may be used. In this way, by changing the number of ND filters 272 and R, G, B filters which are inserted, the amount of light and the color of the light illuminated from the light source 270 can be changed.

In place of the color correcting filter 274 illustrated in FIG. 6, planar color filters of desired colors may be disposed so as to oppose the glass plate 242 and may be freely substituted. By changing the planar color filters arbitrarily, the color of the light illuminated from the light source 270 can be changed.

A fan 278 is disposed in a vicinity of the lamp unit 244, i.e., at one end portion of the frame 240, and cools the interior of the proof unit 200.

Figure 8:
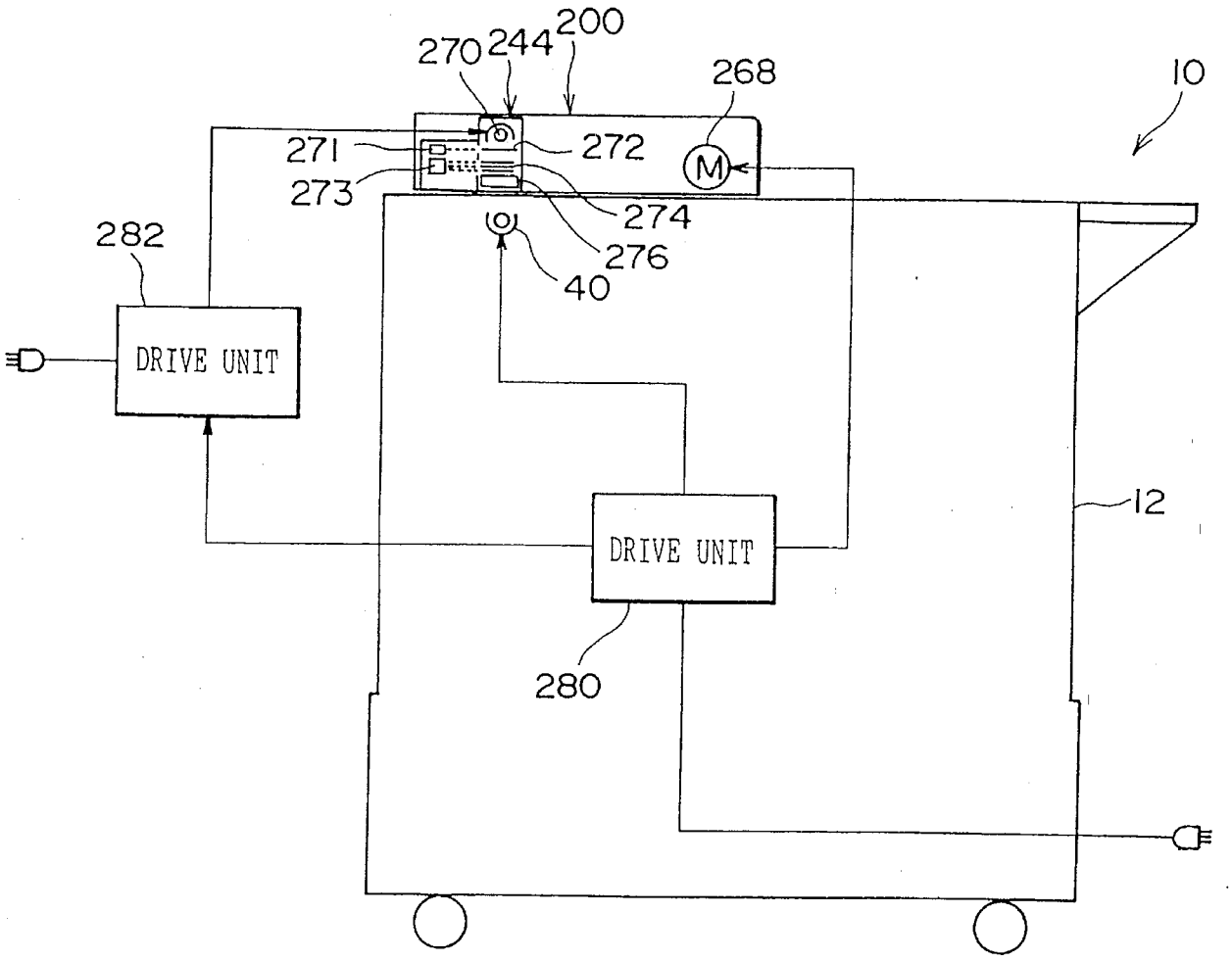
FIG. 8 is a schematic block view illustrating the structure of drive parts of the proof unit of the copying apparatus relating to the first embodiment of the present invention.

As illustrated schematically in FIG. 8, the lamp unit 244 (light source 270) of the proof unit 200 structured as described above is connected to a drive unit 282 which is provided separately from the drive unit 280 which is disposed at the machine stand 12 of the copying apparatus 10. Further, the drive unit 282 is connected to the drive unit 280. Accordingly, the light source 270 of the lamp unit 244 can be lit independently, and also can be lit simultaneously (more specifically, "synchronously") with the exposure device 38 (i.e., the light source 40). Further, the motor 268 of the proof unit 200 is connected to the drive unit 282 via the drive unit 280. In the same way as the lamp unit 244, the motor 268 can be operated independently, and can also be operated simultaneously (more specifically, "synchronously") with the exposure device 38. Namely, as will be described in detail later, the proof unit 200 can be operated independently at times when the exposure device 38 (e.g., the light source 40) is not operated, and also can be operated synchronously with the exposure device 38.

When the proof unit 200 is operated, light of a predetermined amount and set to a predetermined color is illuminated successively in a slit shape from the surface side of the platen glass 50 (i.e., from the back surface to the original disposed on the platen glass 50, or more specifically, from the UP direction to the DOWN direction in FIG. 4) so as to be scanned and exposed. Among the light which is illuminated to the platen glass 50, the transmitted light which is transmitted through the platen glass 50 is scanned and exposed onto the photosensitive material 16 which is positioned at the exposure section 22.

In the proof unit 200 structured as described above, among the surfaces which are upright in the UP direction in FIG. 6, two adjacent surfaces are held by pantographs 202 and 204 which serve as holding means.

Figure 9:
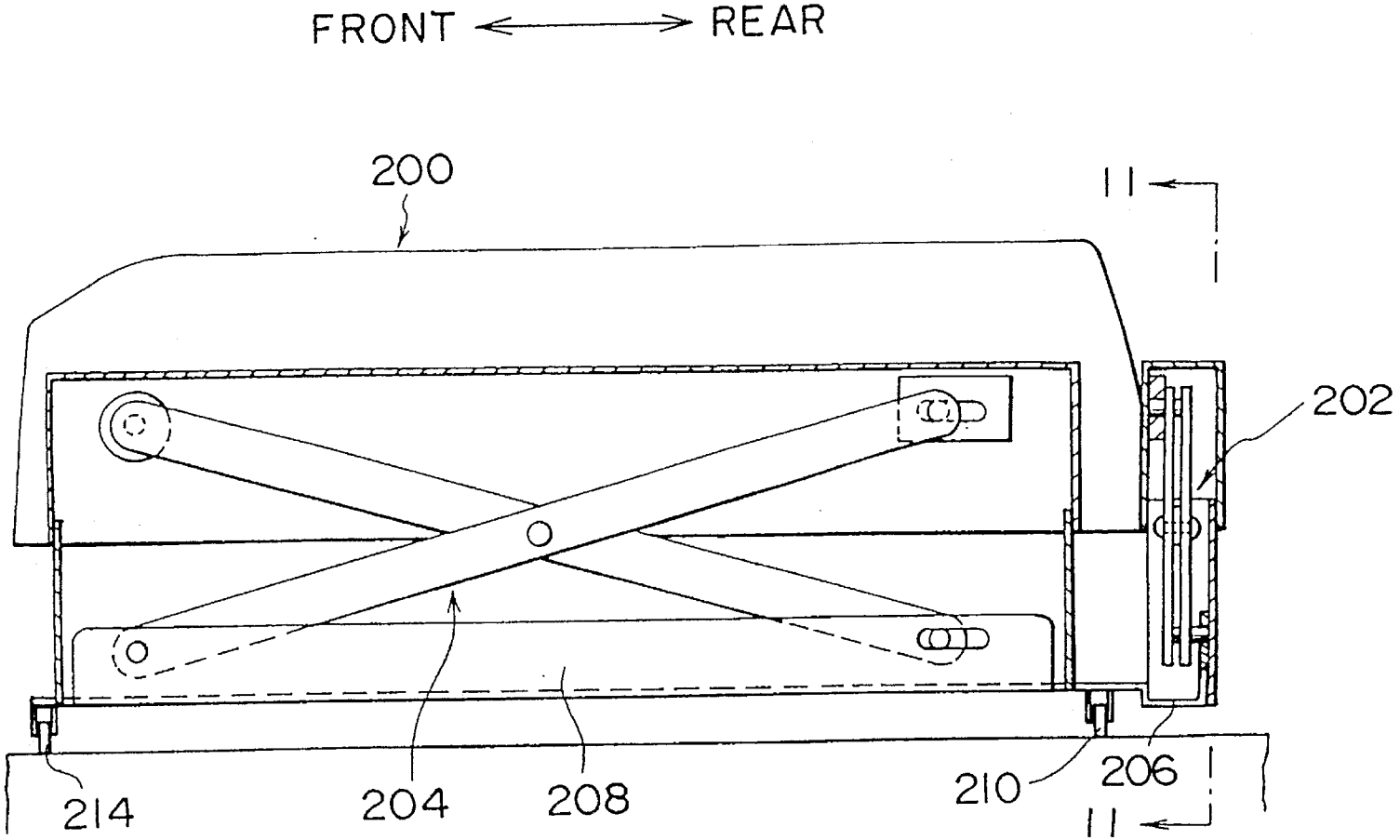
FIG. 9 is a sectional view taken along line 9—9 of FIG. 11 and illustrating a state in which a pantograph at the right surface side of the proof unit is extended.
Figure 10:
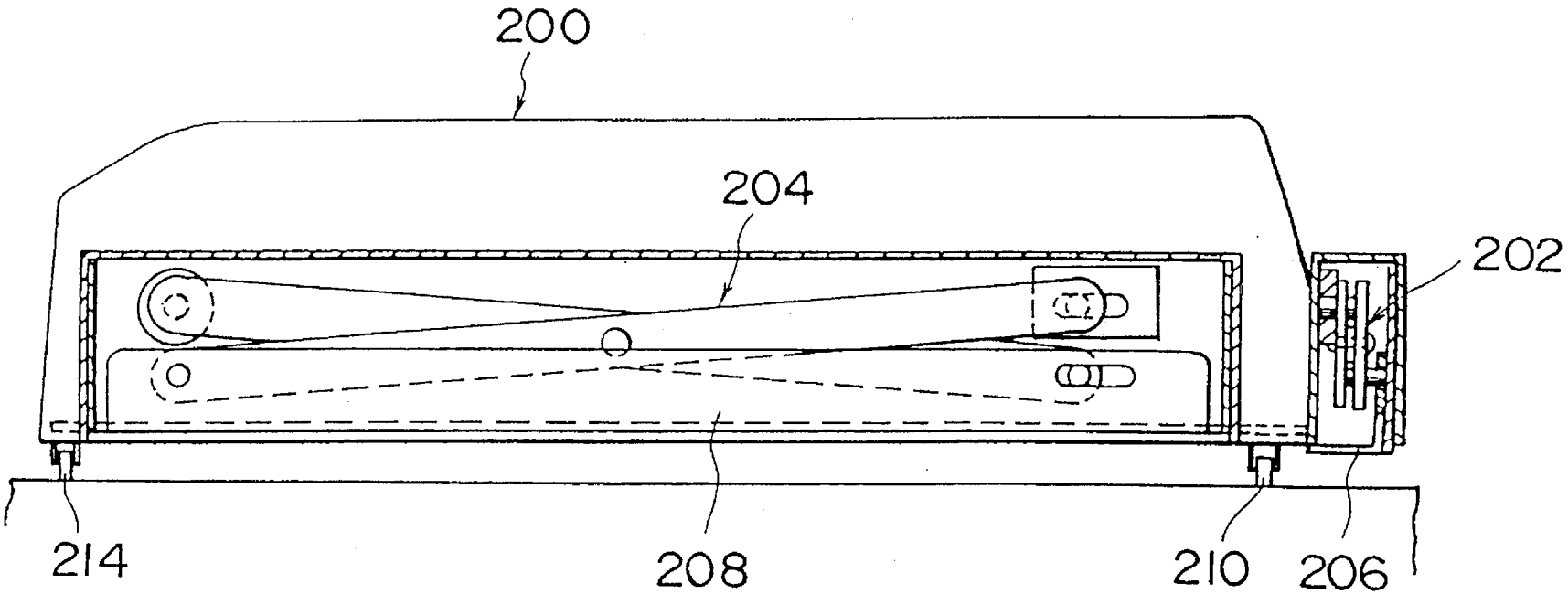
FIG. 10 is a sectional view corresponding to FIG. 9 and illustrating a state in which the pantograph at the right surface side of the proof unit is contracted.
Figure 11:
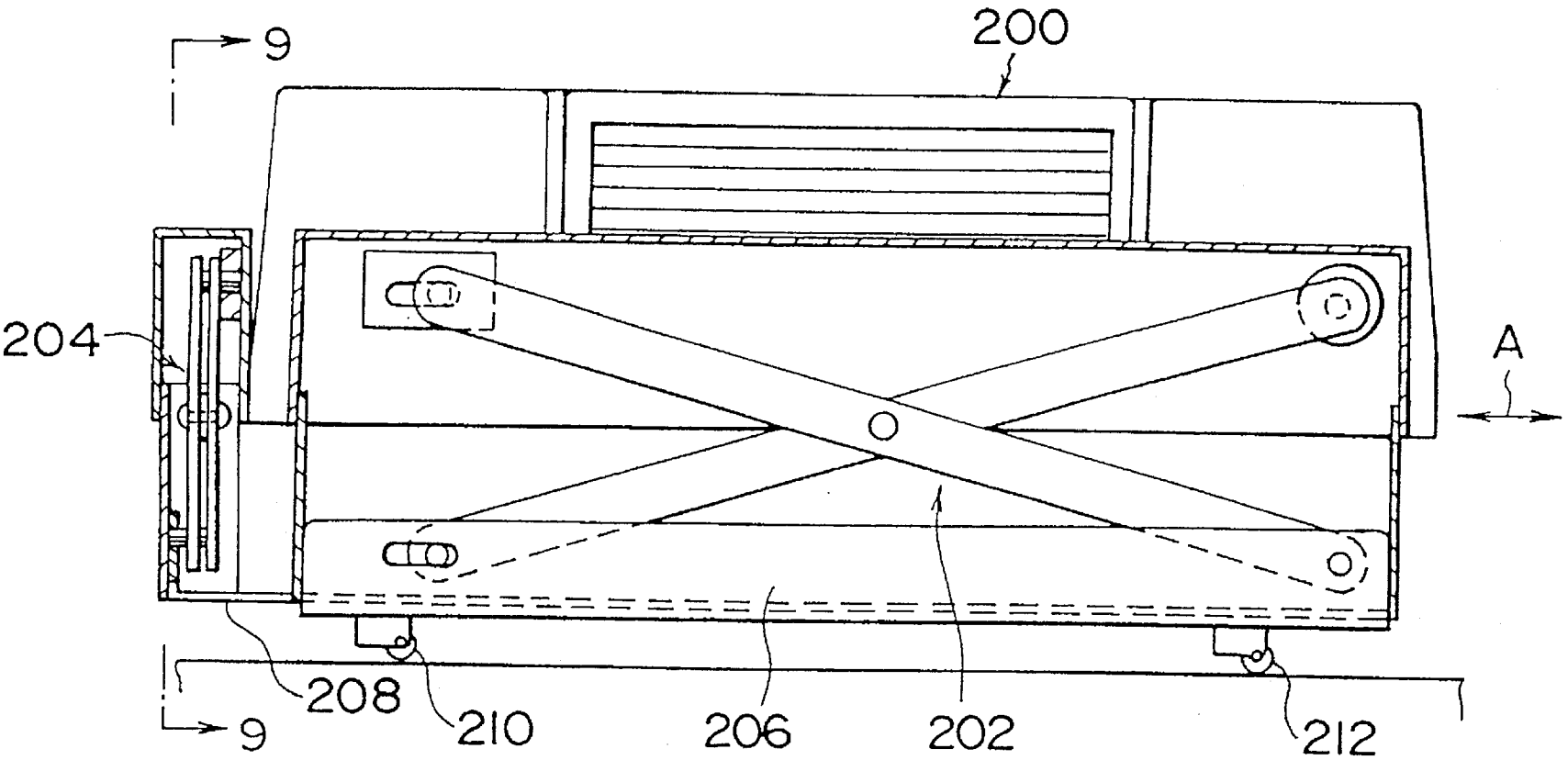
FIG. 11 is a sectional view taken along line 11—11 of FIG. 9 and illustrating a state in which a pantograph at a rear surface of the proof unit is extended.

In other words, as illustrated in FIGS. 9 through 11, the pantograph 202, which is connected to a supporting plate 206, is connected to the rear surface of the proof unit 200, i.e., the surface in the REAR direction in FIG. 9. Further, the pantograph 204, which is connected to a supporting plate 208 which is provided integrally with the supporting plate 206, is connected to the right side surface of the proof unit 200 (i.e., to the surface at the right side of the proof unit 200 illustrated in FIG. 1). Further rollers 210, 212 are mounted to the longitudinal direction end portions of the supporting plate 206, and a roller 214 is mounted to one end portion of the supporting plate 208 in the longitudinal direction thereof.

Figure 12:
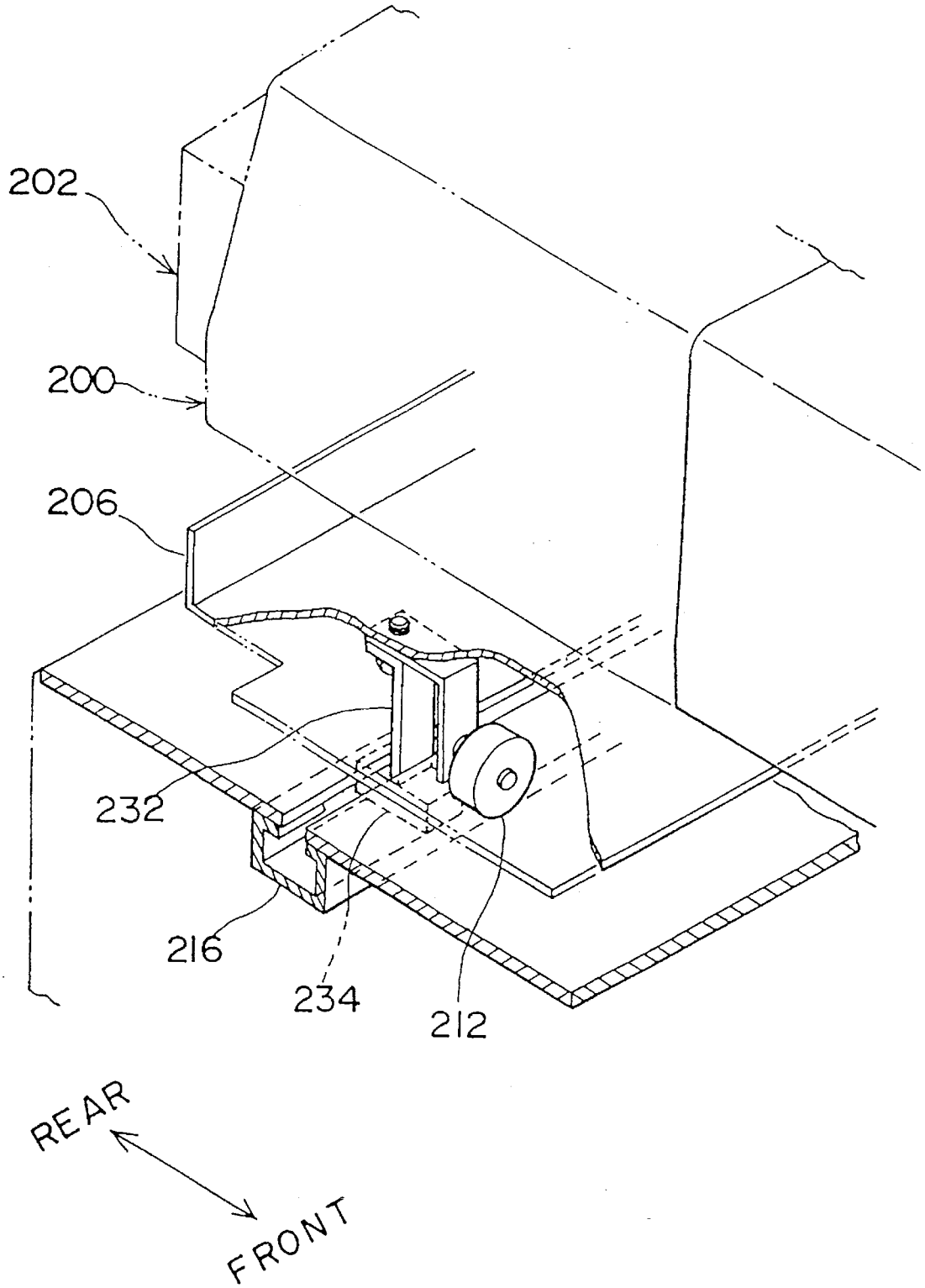
FIG. 12 is a partially broken perspective view illustrating a rail and a holder which holds the proof unit.
Figure 13:
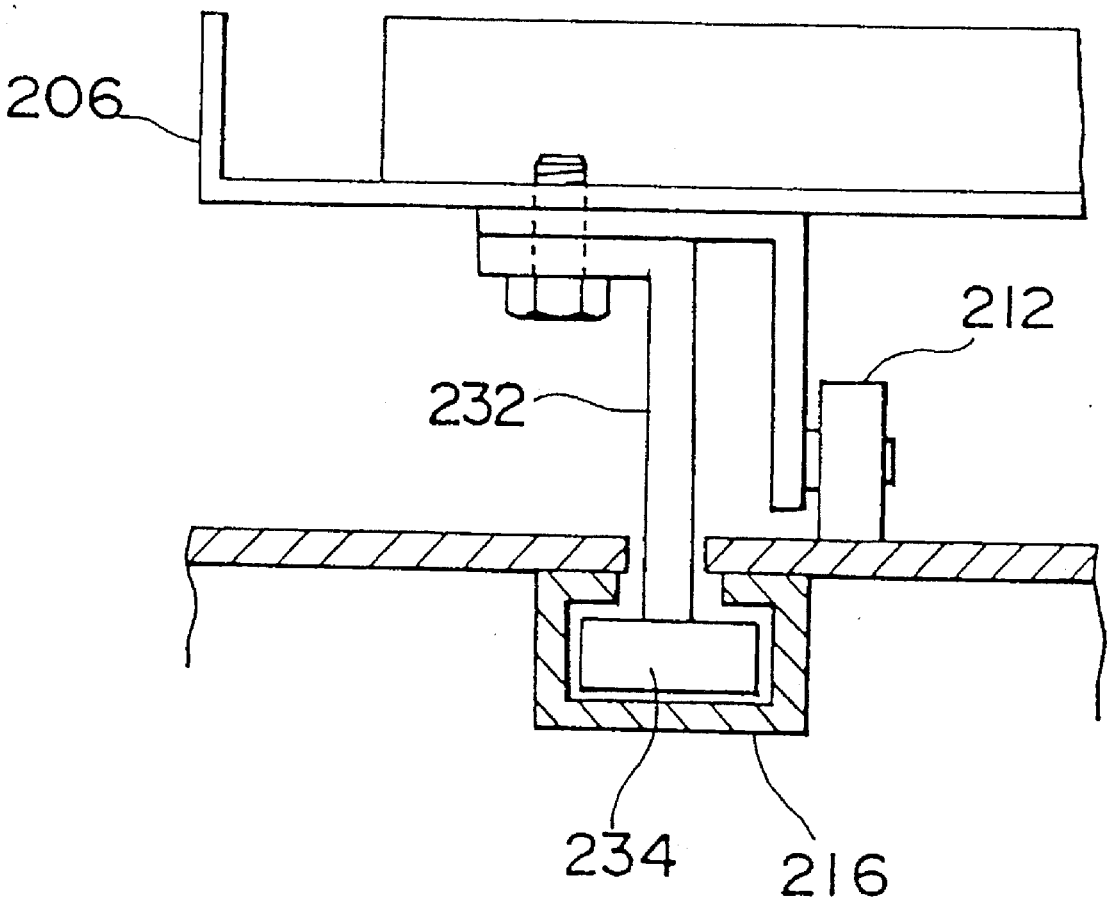
FIG. 13 is a sectional view corresponding to FIG. 12 and illustrating the rail and the holder which holds the proof unit.

As illustrated in FIGS. 12 and 13, a holder 234 is mounted via a bracket 232 in respective vicinities of the rollers 210 (unillustrated) and 212 which are positioned in a vicinity of the rear surface of the proof unit 200 (i.e., in a vicinity of the surface in the REAR direction in FIG. 12). The holders 234 are positioned within a rail 216 which is disposed along left and right directions of the machine stand 12 (i.e., in the direction of arrow A in FIGS. 1 through 3) so as to be able to slide along the rail 216. Accordingly, the proof unit 200 is held by the holders 234 such that inclination of the proof unit 200 toward the front side surface of the machine stand 12 (i.e., toward the FRONT direction in FIG. 12) can be deterred. The proof unit 200 is movable along the rail 216 in left and right directions of the machine stand 12 while the respective rollers 210, 212, 214 roll on the machine stand 12. Accordingly, due to the movement of the proof unit 200 in left and right directions of the machine stand 12, the proof unit 200 can move to and withdraw from a position which opposes the surface of the platen glass 50.

When the proof unit 200 has moved to a position which opposes the surface of the platen glass 50, the proof unit 200 can be moved in vertical directions (i.e., in the directions of arrow B in FIGS. 1 through 3) due to the expansion and contraction of the pantograph 202 and the pantograph 204. When the pantograph 202 and the pantograph 204 are extended, the proof unit 200 can be held in a state whereby the proof unit 200 is separated in an upward direction (namely, the direction of arrow B in FIGS. 1 through 3) from the surface of the platen glass 50 by a predetermined distance (e.g., 70 mm in the present embodiment).

As illustrated in FIGS. 14 through 18, white boards 218, 220, which serve as reflecting members, are mounted to the underside of the proof unit 200 (i.e., the surface of the frame 240 which opposes the platen glass 50) via supporting rods 226, 228.

The white boards 218, 220 are thin and plate-shaped, and elongated holes 222, 224 are formed therein, respectively. The supporting rods 226, 228 which are supported by the frame 240 of the proof unit 200 are inserted into the elongated holes 222, 224 so that the white boards 218, 220 are held so as to be movable. Namely, in the state in which the proof unit 200 is held so as to be separated in an upward direction from the platen glass 50, the white boards 218, 220 move downward due to their own weight together with the supporting rods 226, 228 so as to contact the surface of the platen glass 50 (the state illustrated in FIGS. 14 and 15). Accordingly, regardless of the position at which the proof unit 200 is held by the pantograph 202 and the pantograph 204, the white boards 218, 220 are positioned at predetermined places on the platen glass 50 when the proof unit 200 is in an operating state, i.e., when the proof unit 200 is held so as to be separated from the platen glass 50 in the upward direction. Light illuminated from the exposure device 38 (i.e., the light source 40) is reflected by the white boards 218, 220 so that the reflected light can be exposed onto the photosensitive material 16 positioned at the exposure section 22. In the present embodiment, in the state in which the white boards 218, 220 contact the surface of the platen glass 50 due to their own weight, the white boards 218, 220 are positioned at the upper and lower edge portions of the exposure surface (i.e., the image).

By moving the positions at which the white boards 218, 220 are held by the supporting rods 226, 228 along the elongated holes 222, 224, the white boards 218, 220 can be withdrawn from the periphery of the platen glass 50 (i.e., the exposure surface). Accordingly, in this state, a regular image is exposed onto the photosensitive material 16 without the light illuminated from the exposure device 38 (more specifically, the light source 40) being illuminated onto the white boards 218, 220.

Further, a ferrite magnet 230 is fixed to the respective central portions of the white boards 218, 220 so that the white boards 218, 220 can contact the underside portion of the proof unit 200 due to magnetic force. Accordingly, after the white boards 218, 220 are moved along the elongated holes 222, 224 and are withdrawn from the platen glass 50 (the exposure surface), this withdrawn state can be maintained.

Operation of the first embodiment will now be described. First, copying of a regular original by the copying apparatus 10 structured as described above will be explained.

When a regular original is to be copied, the proof unit 200 is not used (not operated), and only the main body of the copying apparatus 10 is operated. Namely, the pantograph 202 and the pantograph 204 which hold the proof unit 200 are contracted so that the proof unit 200 is set at its lowest height. The proof unit 200 is moved along the rail 216 toward the right of the machine stand 12 so as to be separated from the platen glass 50 (i.e., the proof unit 200 moves to the state illustrated by the two-dot chain line in FIG. 3). Further, the positions at which the white boards 218, 220 are held by the supporting rods 226, 228 are moved along the elongated holes 222, 224 so that the white boards 218, 220 are withdrawn from their positions opposing the platen glass 50 (the exposure surface). The white boards 218, 220 cling to the underside portion of the proof unit 200 due to the magnetic force of the ferrite magnets 230.

After the photosensitive material magazine 14 has been set in the copying apparatus 10, the photosensitive material 16 is pulled out from the photosensitive material magazine 14 by the nip rollers 18 and is cut to a predetermined length by the cutter 20. The cut photosensitive material 16 is conveyed by the conveying rollers 19, 21, 23 to the exposure section 22 in a state in which the photosensitive surface (i.e., the exposure surface) of the photosensitive material 16 faces upward. At the point in time when the photosensitive material 16 is nipped by the conveying rollers 26, the driving of the conveying rollers 26 is stopped once so that the photosensitive material 16 is set in a standby state at the exposure section 22.

On the other hand, while the photosensitive material 16 is being conveyed, pre-scanning of the original on the original holding plate is effected.

First, the light source 40 is operated, and the reflecting mirror 46 is inserted onto the optical path of light illuminated to the exposure section 22 via the moving mirrors 42A, 42B and the fixed mirror 44 so that the light reflected from the image of the original is reflected in a substantially orthogonal direction by the reflecting mirror 46. The reflected light enters the light detecting sensor 56, and the image density of the image on the original is measured (i.e., it is determined whether the image on the original is a print original or a photographic original). The exposure conditions of the color correcting filter (CC filter) and the aperture slit plate 52 are set on the basis of the measured value.

Subsequently, the reflection mirror 46 is removed from the optical path of the image light, and the light source 40, the moving mirrors 42A, 42B and the lens unit 48 return to their home positions (i.e., their positions at the start of image scanning).

When the driving of the conveying rollers 24 and the conveying rollers 26 is started again, the photosensitive material 16 passes through the exposure section 22 at a predetermined speed (e.g., 100 mm/sec). At this time, because the guide plate 28 and the exposure surface glass 30 are disposed in the exposure section 22, the photosensitive material 16 is made flat (i.e., deformation thereof is corrected) as the photosensitive material 16 passes between the sets of conveying rollers (i.e., through the exposure section).

Simultaneously with the conveying of the photosensitive material 16 (i.e., at the same time the photosensitive material 16 passes through the exposure section 22), the light source 40, the moving mirrors 42A, 42B and the lens unit 48 are moved along the platen glass 50, and light is illuminated to the original which is disposed on the platen glass 50. The reflected image light (image light) is scanned and exposed via the fixed mirror 44 onto the photosensitive material 16 which is positioned at the exposure section 22.

After exposure has begun, the exposed photosensitive material 16 is successively guided by the guide plate 27 (such that the image exposure surface thereof is oriented downward), and thereafter, is delivered into the water application section 62 by the conveying rollers 29, 31, 33, 35.

In the water application section 62, the conveyed photosensitive material 16 is delivered in between the guide plate 70 and the application tank 64 due to the driving of the supply rollers 66 and the squeeze rollers 66. Further, the photosensitive material 16 is nipped and conveyed by the squeeze rollers 68. Accordingly, water is applied to the photosensitive material 16 and excess water is removed therefrom by the squeeze rollers 68 while the photosensitive material 16 passes through the water application section 62.

The photosensitive material 16, to which water serving as an image forming medium was applied in the water application section 62, is conveyed into the heat development transfer section 104 by the squeeze rollers 68.

The image receiving material 108 is pulled out from the image receiving material magazine 106 by the nip rollers 110 and is cut to a predetermined length by the cutter 112. The image receiving material 108 is guided by the image receiving material conveying section 180 and is delivered into the heat development transfer section 104.

In the heat development transfer section 104, the photosensitive material 16 and the image receiving material 108 are delivered between the outer periphery of the heat drum 116 and the laminating roller 120.

The photosensitive material 16 and the image receiving material 108 which are superposed by the laminating roller 120 are nipped, while in their superposed state, between the heat drum 116 and the endless pressure-contact belt 118, and are conveyed over approximately one-half of the periphery of the heat drum 116 (i.e., between the training roller 134 and the training roller 140). When the photosensitive material 16 is heated while being nipped and conveyed, mobile pigments are emitted. Simultaneously, the pigments are transferred to the pigment fixing layer of the image receiving material 108 so that an image is obtained.

Thereafter, when the photosensitive material 16 and the image receiving material 108 are nipped and conveyed and reach the bottom portion of the outer periphery of the heat drum 116, the peeling claw 154 is moved by an unillustrated solenoid. The peeling claw 154 engages the leading end portion of the photosensitive material 16, which is being conveyed such that the photosensitive material 16 precedes the image receiving material 108 by a predetermined length. The peeling claw 154 peels the leading end portion of the photosensitive material 16 from the outer periphery of the heat drum 116. Due to the peeling of the leading end portion of the photosensitive material 16 from the outer periphery of the heat drum 116, the entire photosensitive material 16 is peeled continuously from the outer periphery of the heat drum 116.

After being trained around the bending/guiding roller 142, the peeled photosensitive material 16 is conveyed by the photosensitive material discharge rollers 158. Further, after being dried while being guided by the guide rollers 162, the photosensitive material 16 is conveyed to the waste photosensitive material accommodating box 178 by the photosensitive material discharge rollers 160 and is accumulated therein.

On the other hand, the image receiving material 108, which has been separated from the photosensitive material 16 and which moves while continuing to adhere to the heat drum 116, passes between the heat drum 116 and the peeling claw 154, which is in a state of being separated from the outer periphery of the heat drum 116, and is delivered to the peeling roller 174. The image receiving material 108 is peeled from the outer periphery of the heat drum 116 by the peeling roller 174 and the peeling claw 176, is conveyed by the image receiving material discharge rollers 172, and is accumulated on the tray 177.

Next, copying of a transparency original (i.e., contact print type copying) by the copying apparatus 10 will be described.

When a transparency original is to be copied (i.e., and original which is copied by light being transmitted therethrough), the light source 40 of the exposure device 38 is not operated (i.e, is not lit), and the moving mirror 42A, the moving mirror 42B, the lens unit 48 and the proof unit 200 are operated.

Namely, after the transparency original which is to be copied is disposed on the platen glass 50, the proof unit 200 is operated so as to be moved along the rail 216 from the position illustrated by the two-dot chain line in FIG. 3 toward the left of the machine stand 12, and is set at a position opposing the surface of the platen glass 50. The pantograph 202 and the pantograph 204 are in their contracted states so that the proof unit 200 is at its lowest height, and the proof unit 200 is substantially fit to the transparency original disposed on the platen glass 50.

After the proof unit 200 has been set, the light source 270 and the motor 268 of the lamp unit 244 are operated. Light from the light source 270 is successively illuminated in a slit configuration to the back surface of the transparency original disposed on the platen glass 50 (i.e., the surface of the transparency original which is opposite to the surface thereof which faces the platen glass 50). Accordingly, the light which is transmitted through the transparency original is scanned and exposed onto the photosensitive material 16 positioned at the exposure section 22 so that the image of the transparency original is recorded.

In this case, the ND filter 272 which changes the amount of light illuminated from the proof unit 200, and the color correcting filter 274, which changes the color of the light illuminated from the proof unit 200, are built in the proof unit 200 (i.e., the lamp unit 244). Therefore, the exposure conditions of the image of the transparency original to be copied can be set arbitrarily, and the image can be recorded.

Next, explanation will given of a case in which a three-dimensional object is copied by the copying apparatus 10.

When a three-dimensional object is to be copied, the light source 40 of the exposure device 38 as well as the proof unit 200 are operated.

Namely, the proof unit 200 is operated so as to be moved along the rail 216 from the position illustrated by the two-dot chain line in FIG. 3 toward the left of the machine stand 12, and be is set at a position opposing the surface of the platen glass 50. Next, the pantograph 202 disposed at the rear surface of the proof unit 200 (i.e., at the surface in the REAR direction in FIG. 9) and the pantograph 204 disposed at the right surface of the proof unit 200 (i.e., at the surface at the right side in the direction of arrow A in FIG. 3) are extended so as to hold the proof unit 200 in a state in which it is separated by a predetermined distance (70 mm) in an upward direction from the platen glass 50 (i.e., the state illustrated in FIGS. 3, 9, and 11).

Figure 18:
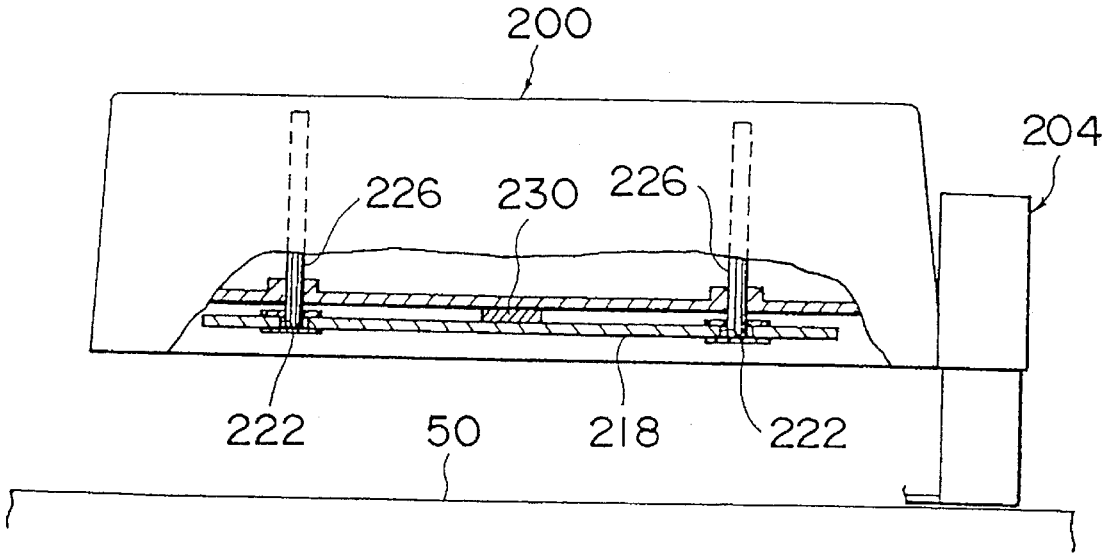
FIG. 18 is a partially broken front view corresponding to FIG. 15 and illustrating a state in which the white board is disposed when the pantographs of the proof unit are held in their extended states and the white board is held at the proof unit by magnetic force.

Even in the state in which the proof unit 200 is separated from the platen glass 50 in an upward direction, the proof unit 200 is held by the holders 234 positioned within the rail 216. Therefore, the proof unit 200 does not incline unnecessarily toward the front surface side of the machine stand 12 (i.e., the operation panel 180 side). In this state, as illustrated in FIG. 18, the white boards 218, 220 are still in a state in which they are withdrawn from positions corresponding to the platen glass 50 (the exposure surface), and cling to and are held at the underside portion of the proof unit 200 due to magnetic force.

Next, the three-dimensional object, which is the object to be copied, is inserted between the proof unit 200 and the platen glass 50 and is placed on the platen glass 50. In this case, only the rear surface side and the right surface side of the proof unit 200 are held by the pantograph 202 and the pantographs 204. In other words, there are no covers at the front surface side and the left surface side of the proof unit 200, and the space between the proof unit 200 and the platen glass 50 is sufficiently open. Therefore, there is nothing to obstruct the insertion of the three-dimensional object to be copied between the proof unit 200 and the platen glass 50, and the three-dimensional object can be easily inserted and placed therebetween.

After the three-dimensional object to be copied is placed on the platen glass 50, the exposure device 38 is operated in the same manner as described above, and light from the light source 40 is illuminated successively onto the three-dimensional object which is disposed on the platen glass 50. Simultaneously, the lamp unit 244 (the light source 270) and the motor 268 of the proof unit 200 are operated synchronously with the exposure device 38, so that light is successively and synchronously illuminated in a slit shape by the proof unit 200 to the back surface of the three-dimensional object disposed on the platen glass 50 (i.e., the surface of the three-dimensional object which is opposite to the surface thereof which faces the platen glass 50).

Accordingly, the image light reflected from the three-dimensional object is scanned and exposed onto the photosensitive material 16 positioned at the exposure section 22, and the light passing through the background portions of the three-dimensional object is scanned and exposed onto the photosensitive material 16 positioned at the exposure section 22. In this way, an image of the three-dimensional object disposed on the platen glass 50 is recorded, and the background image of the three-dimensional object is recorded in white.

Therefore, even if a three-dimensional object is copied, the background of the copied object is not black on the recorded image. Further, no irregular shadows caused by covering the three-dimensional object disposed on the platen glass 50 by a cloth or the like are recorded so that an image of extremely high quality is obtained. As a result, the present embodiment can be advantageously applied even to copying requiring high quality such as the copying of printed boards, the copying of internal organs in the medical field, and the copying of documents or the like in other scientific fields, at the actual size of the object (of course, magnification of the object can be easily effected as well).

In the proof unit 200, the platen glass 50 is illuminated in a slit shape synchronously with the operation of the exposure device 38. Therefore, compared with conventional structures in which the platen glass surface is illuminated by light in planar form, the manageability of the present invention is good and there are no adverse effects due to the generation of heat.

Further, the ND filter 272, which changes the amount of illuminated light, and the color correcting filter 274, which changes the color of the illuminated light, are built in the lamp unit 244 of the proof unit 200. Because the exposure conditions can be set as desired by the ND filter 272 and the color correcting filter 274, exposure and recording can be effected so that the background image of the three-dimensional object to be copied is white or any other desired color.

Even if a three-dimensional object is to be copied by the copying apparatus 10, the quality of the recorded image can be maintained, and an image can be recorded with the background color of the three-dimensional object to be copied being set by the proof unit 200 as desired.

When a three-dimensional object is copied by using the proof unit 200, supplemental image information can be recorded by use of the white boards 218, 220.

Figure 14:
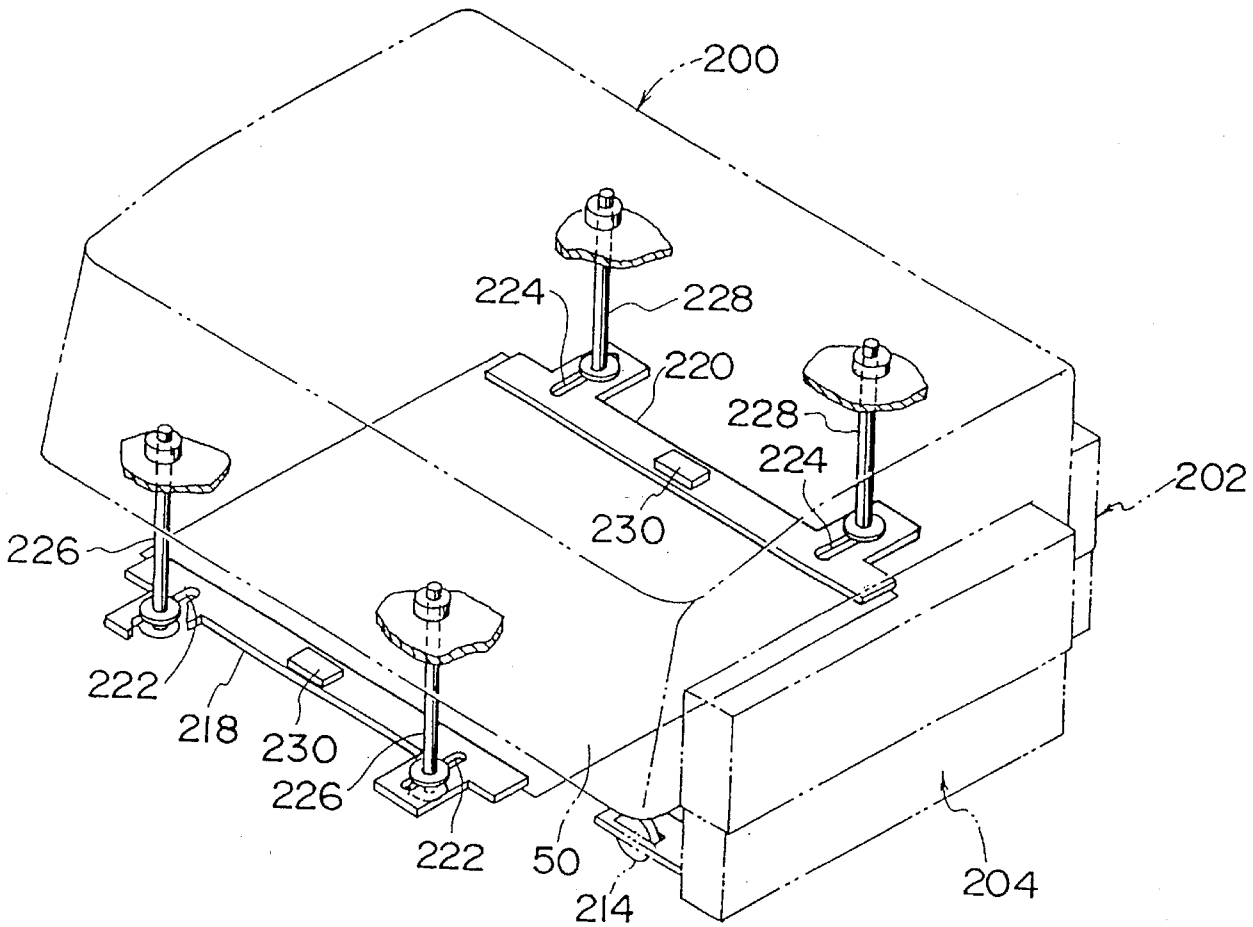
FIG. 14 is a perspective view through the proof unit which illustrates a state in which a white board is disposed when the pantographs of the proof unit are held in their extended states.
Figure 15:
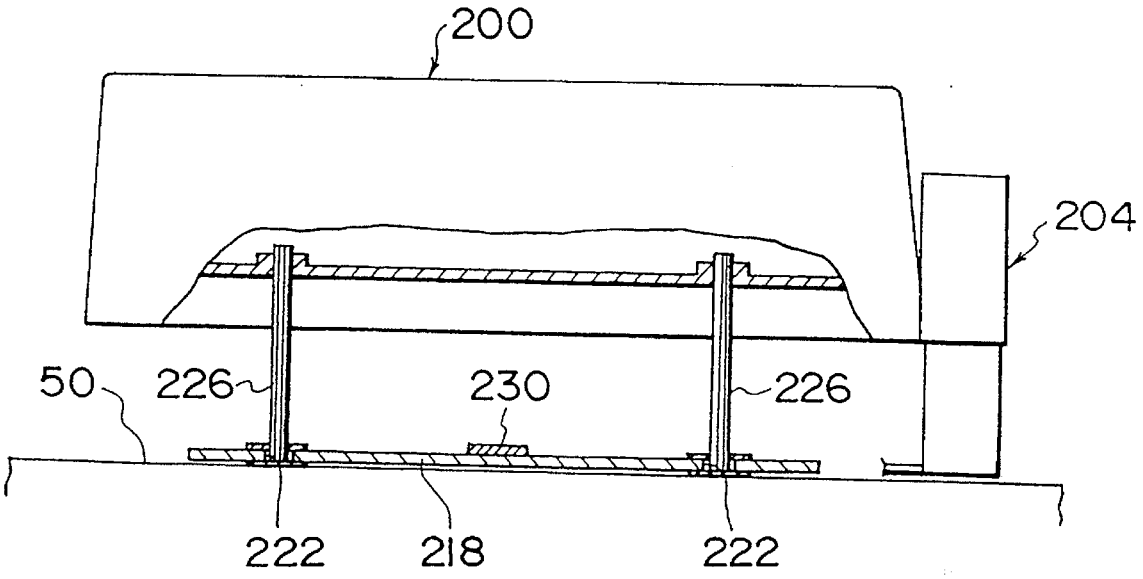
FIG. 15 is a partially broken front view corresponding to FIG. 14 and illustrating a state in which the white board is disposed when the pantographs of the proof unit are held in their extended states.
Figure 16:
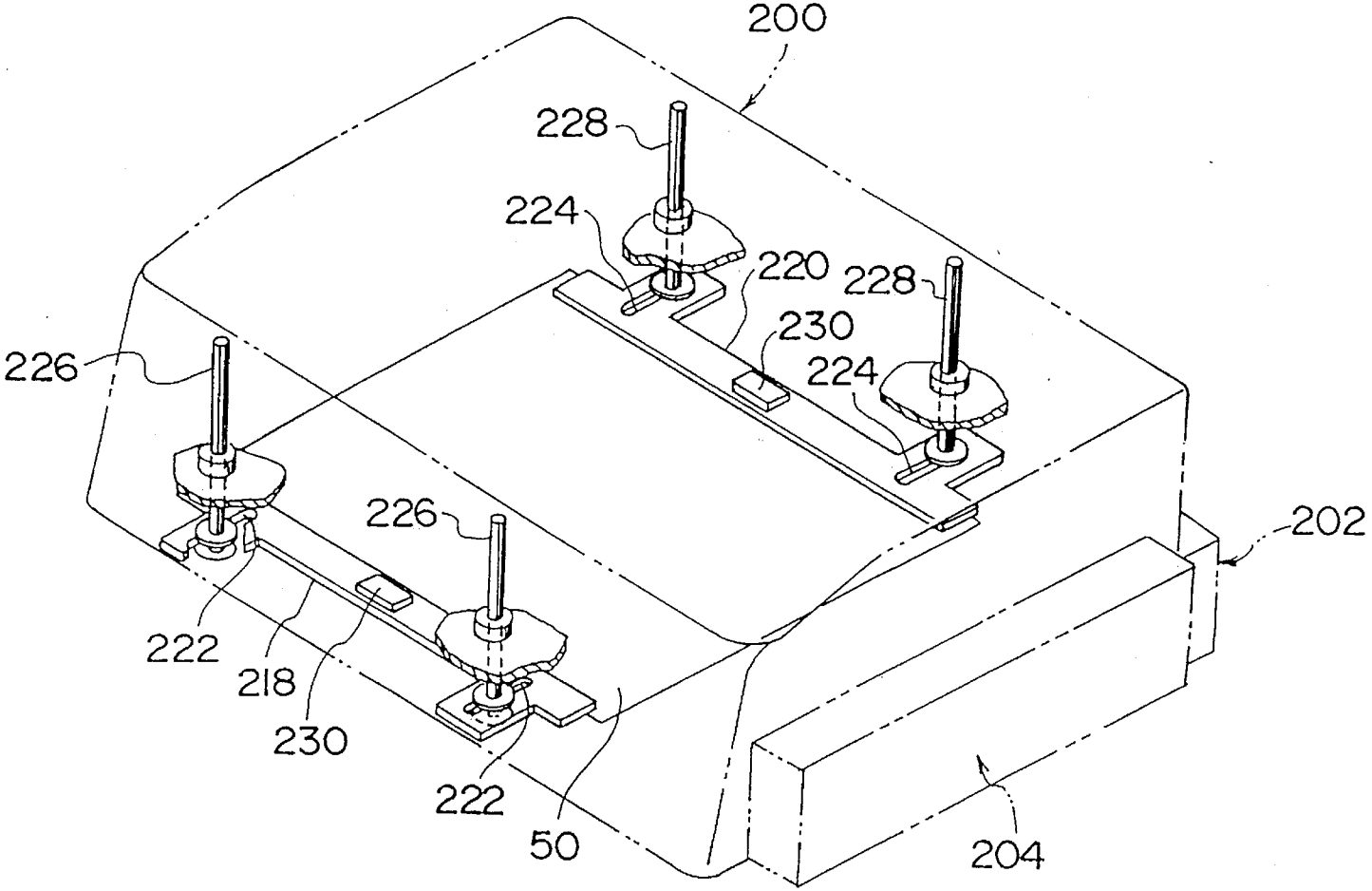
FIG. 16 is a perspective view through the proof unit which illustrates a state in which the white board is disposed when the pantographs of the proof unit are held in their contracted states.
Figure 17:
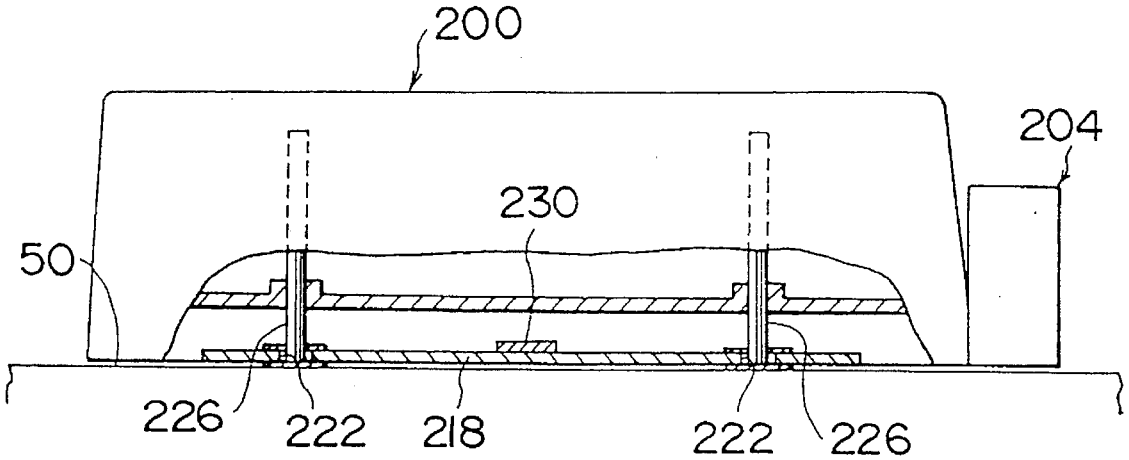
FIG. 17 is a partially broken front view corresponding to FIG. 16 and illustrating a state in which the white board is disposed when the pantographs of the proof unit are held in their contracted states.

Namely, the white boards 218, 220, which cling to and are held at the underside portion of the proof unit 200 due to the magnetic force of the ferrite magnets 230 in a state in which the white boards 218,220 are withdrawn from positions corresponding to the platen glass 50 (exposure surface), can be moved by canceling the holding thereof by the ferrite magnets 230. In this way, as illustrated in FIGS. 14 and 15, the white boards 218, 220 move downward due to their own weight together with the supporting rods 226, 228 so as to contact the surface of the platen glass 50. Accordingly, in this state, the white boards 218, 220 are positioned at the upper and lower edge portions of the exposure surface (image).

In this state, when the exposure device 38 and the proof unit 200 are operated synchronously as described above, the light illuminated from the exposure device 38 (light source 40) is reflected by the white boards 218, 220. The photosensitive material 16 positioned at the exposure section 22 is exposed by the reflected light, and a white image is recorded. Therefore, supplemental image information such as the name of the copied three-dimensional object, the date, and the like can be recorded on these white image portions.

By directly including supplemental image information, such as the name of the three-dimensional object, the date or the like, on the white boards 218,220, this supplemental image information can be exposed and recorded onto the photosensitive material 16. Further, another recording medium, e.g., a sheet-like recording medium, on which the supplemental image information is entered in advance, may be adhered to the white boards 218, 220. Moreover, if, for example, a scale, a color chart, a name plate or the like is used in place of the white boards 218, 220, various types of supplemental image information corresponding to the recorded image can easily be recorded.

If recording of the above-described supplemental image information is unnecessary, the white boards 218, 220 are again moved along the elongated holes 222, 224 and are withdrawn from the platen glass 50 (the exposure surface), and the ferrite magnets 230 are drawn to the underside portion of the proof unit 200. In this way, the white boards 218, 220 are not obstructive, and normal image recording (exposure) can be effected.

Further, in an ordinary illuminating device (i.e., a transparency original illuminating device) such as the proof unit 200 or the like, the range of illumination corresponds to the platen glass 50 and is set to the same range or a slightly larger range than the platen glass 50. Accordingly, when a three-dimensional object is copied by the proof unit 200 having an illumination range set in this manner, when the proof unit 200 is operated so as to be separated in an upward direction from the platen glass 50 and copying is effected, regions of insufficient exposure, i.e., so-called "vignetting", are generated at the edge portions at the sides orthogonal to the direction of movement of the lamp unit 244 (light source 270) of the proof unit 200.

However, by appropriately using the white boards 218, 220 as described above, vignetting can be prevented. Further, by using a scale, a color chart, a name plate or the like, portions in which vignetting occurs can be utilized efficiently, resulting in an even better effect.

By appropriately changing the holding position of the proof unit 200 with respect to the platen glass 50 (e.g., a state in which the proof unit 200 is separated from the platen glass 50 by 35 mm in the upward direction) and operating and copying, copying without vignetting can be effected.

Next, a second embodiment of the present invention will be described. Parts which are basically the same as those of the first embodiment are denoted by the same reference numerals, and description thereof is omitted.

Figure 19:
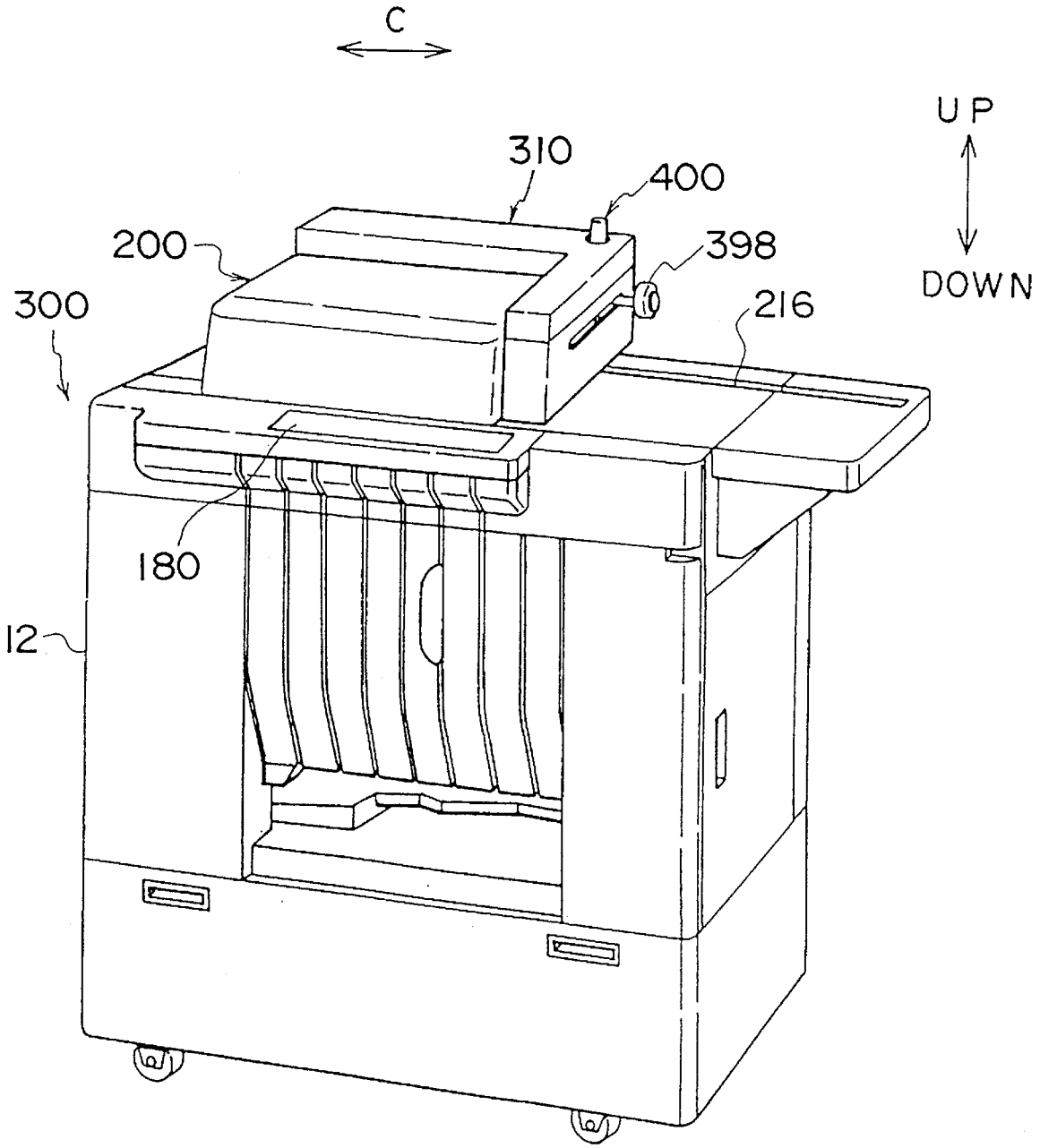
FIG. 19 is an overall perspective view of a copying apparatus relating to a second embodiment of the present invention.

In FIG. 19, an overall external view of a copying apparatus 300 relating to a second embodiment of the present invention is illustrated. In the copying apparatus 300 relating to the second embodiment, the proof unit 200 is held by a raising/lowering device 310, which serves as a holding means, instead of the pantograph 202 and the pantograph 204 of the first embodiment illustrated in FIGS. 9 through 11.

Figure 20:
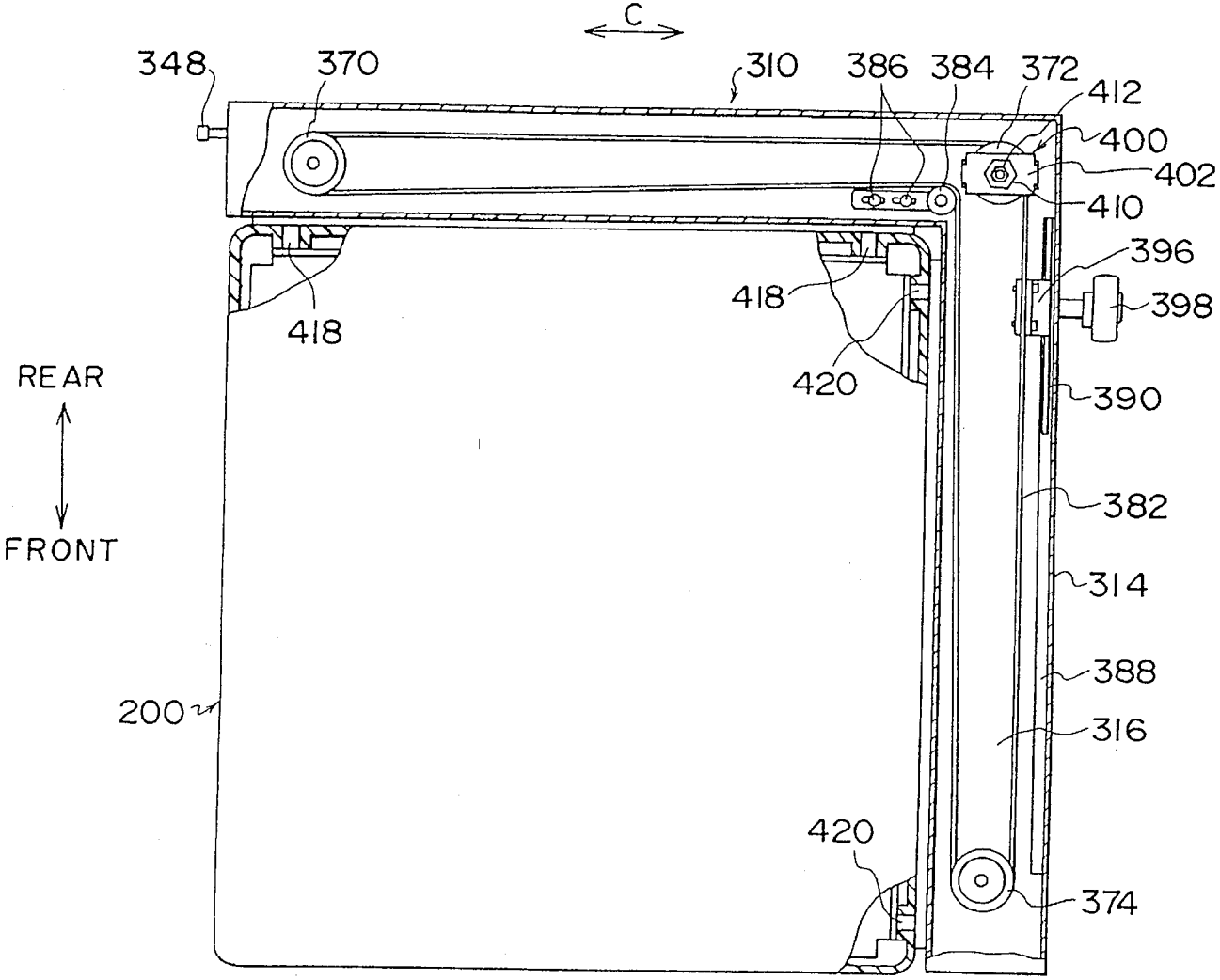
FIG. 20 is a partially broken plan view of a proof unit and a raising/lowering device of the copying apparatus relating to the second embodiment of the present invention.
Figure 21:
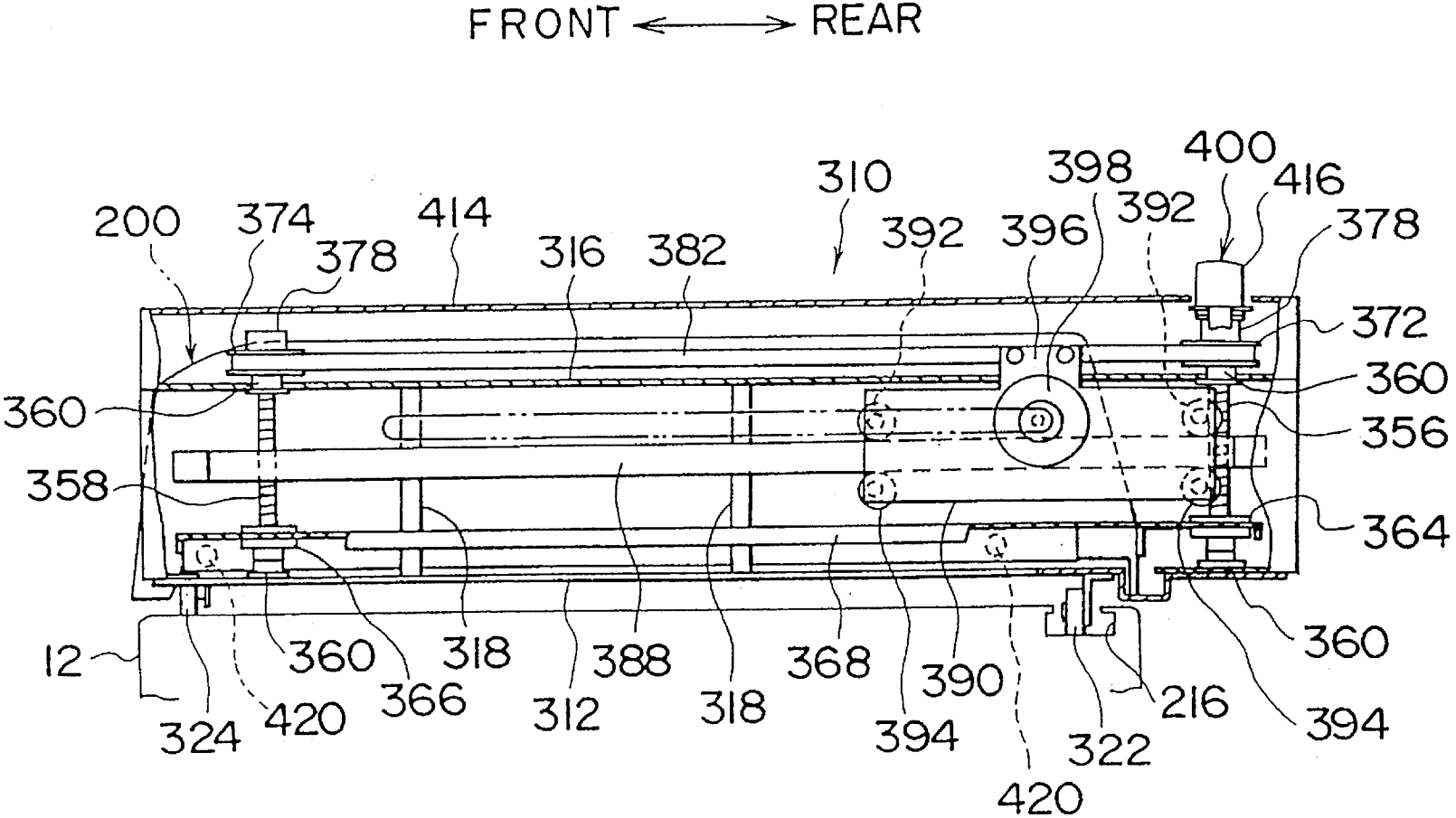
FIG. 21 is a vertical sectional view as seen from a right surface side of the raising/lowering device of the copying apparatus relating to the second embodiment of the present invention.
Figure 22:
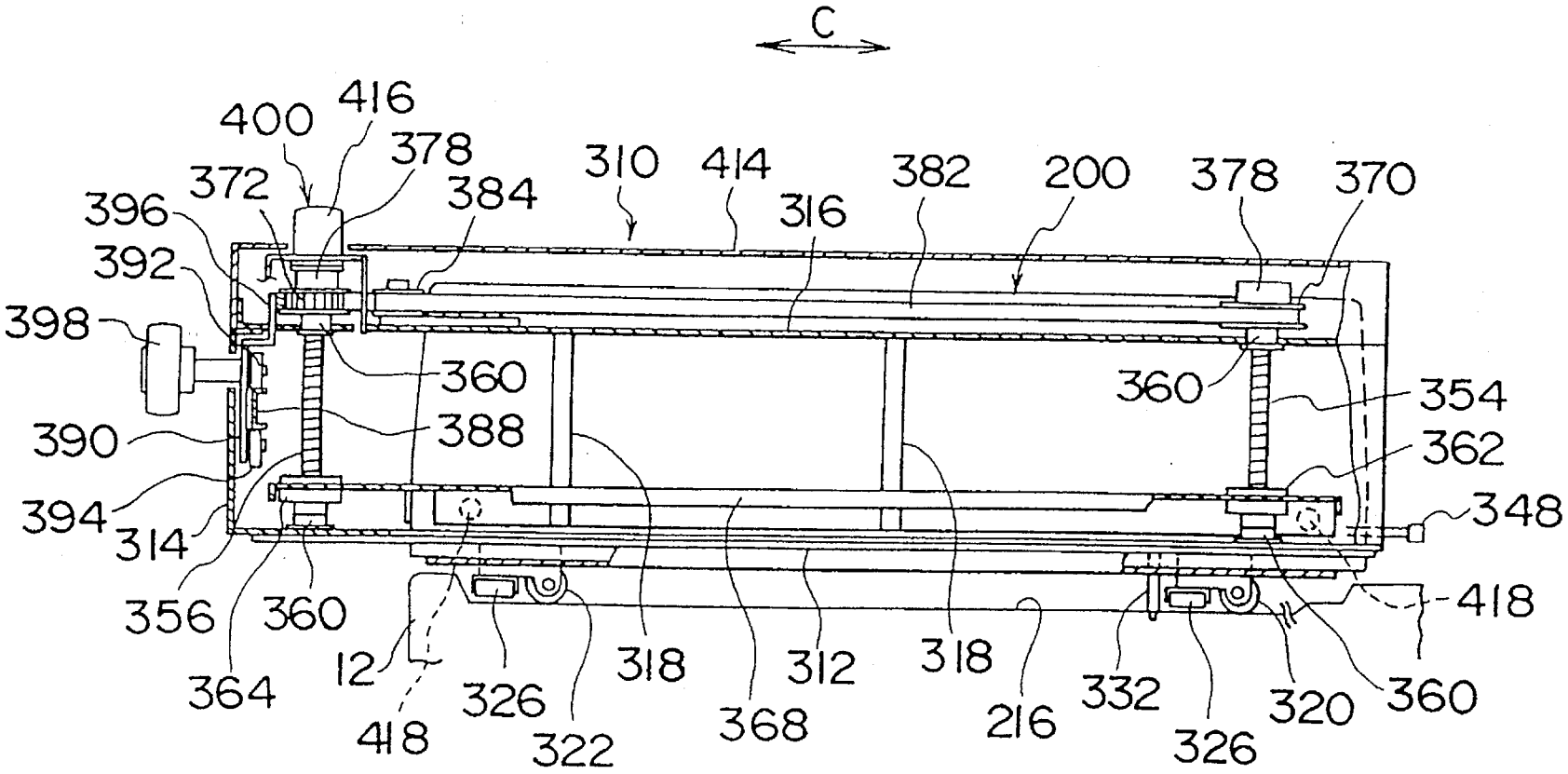
FIG. 22 is a vertical sectional view as seen from a rear surface side of the raising/lowering device of the copying apparatus relating to the second embodiment of the present invention.

FIG. 20 illustrates a partially broken plan view of the proof unit 200 and the raising/lowering device 310. FIG. 21 illustrates a sectional view of the raising/lowering device 310 as seen from the right side surface. In FIG. 22, a sectional view of the raising/lowering device 310 as seen from the rear surface side (i.e., as viewed from the REAR direction toward the FRONT direction in FIG. 20) is illustrated.

As illustrated in FIGS. 20 through 22, in the raising/lowering device 310, a base plate 312, a side wall 314, an upper wall 316 and the like are assembled by a plurality of connecting rods 318 so that the entire structure is shaped as a box which is substantially L-shaped when viewed from above. As in the first embodiment, rollers 320, 322 and a roller 324 are mounted to the base plate 312. A holder 326 is mounted in the vicinity of each of the rollers 320, 322, which are the rollers which are positioned at the side in the REAR direction. The rollers 320, 322 and the respective holders 326 are positioned within the rail 216 which is disposed along left and right directions of the machine stand 12 (i.e., in the direction of arrow C). The holders 326 are slidable along the longitudinal direction of the rail 216. In this way, the raising/lowering device 310 is held by the holders 326 so that inclination thereof toward the front surface side of the machine stand 12 is deterred. The raising/lowering device 310 is movable along the rail 216 in left and right directions of the machine stand 12 while the respective rollers 320, 322 roll within the rail 216 and the roller 324 rolls on the machine stand 12.

A lock section 330 is provided in a vicinity of the roller 320 which is positioned at one end portion of the base plate 312.

Figure 26:
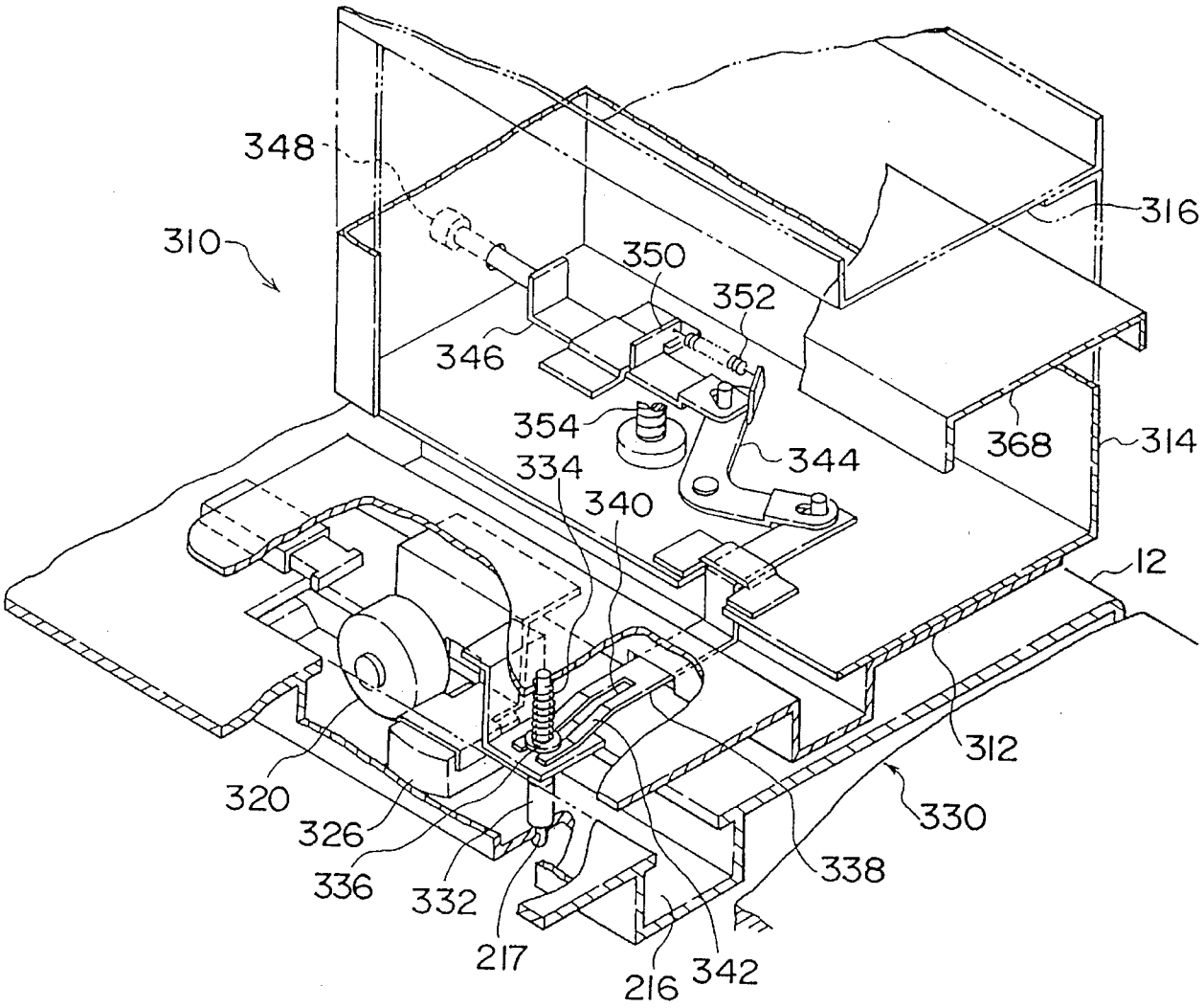
FIG. 26 is a perspective view illustrating a structure of a lock portion of the raising/lowering device of the copying apparatus relating to the second embodiment of the present invention.
Figure 27:
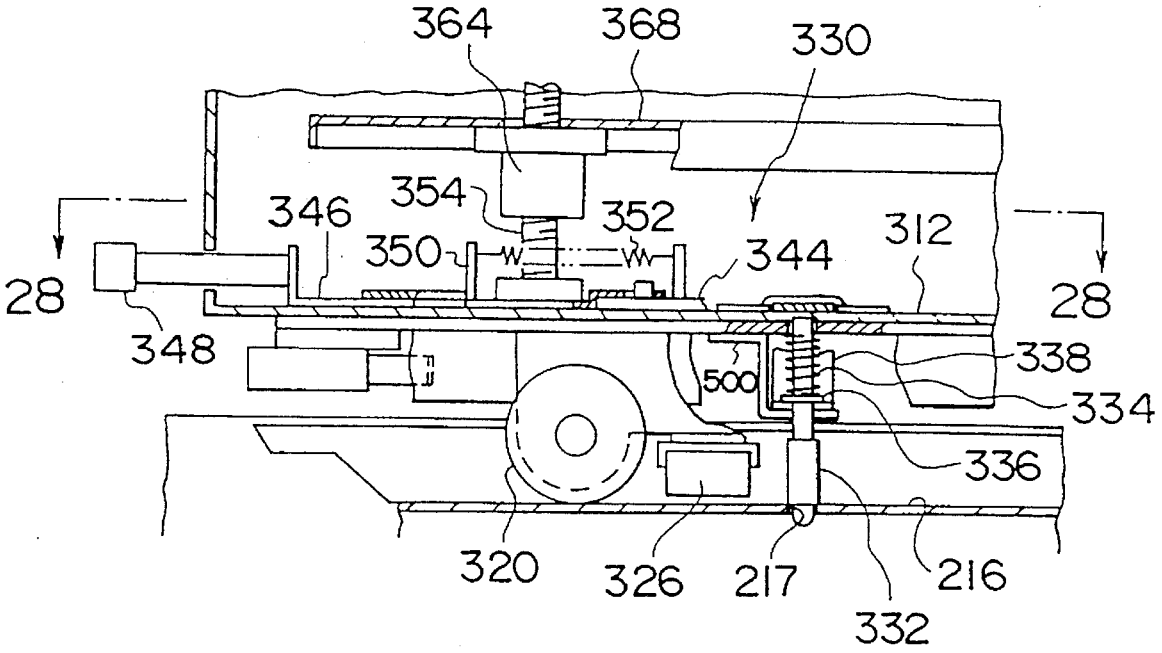
FIG. 27 is a vertical sectional view illustrating the structure of the lock portion of the raising/lowering device of the copying apparatus relating to the second embodiment of the present invention.
Figure 28:
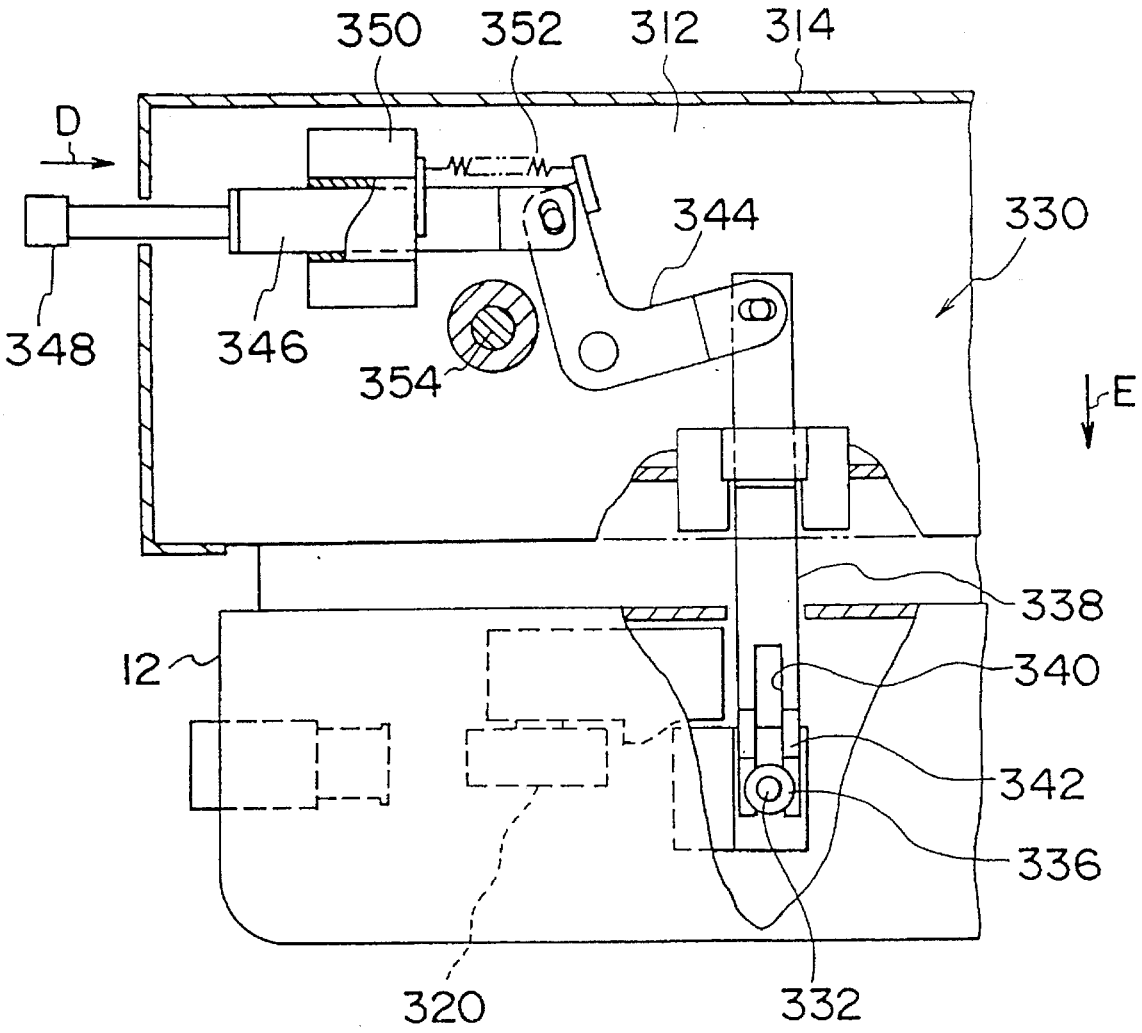
FIG. 28 is a plan view taken along line 28—28 of FIG. 27 and illustrating the structure of the lock portion of the raising/lowering device of the copying apparatus relating to the second embodiment of the present invention.

FIG. 26 illustrates a perspective view of a structure of the lock section 330. Further, FIG. 27 illustrates a vertical sectional view of the lock section 330. In FIG. 28, a plan view of the lock section 330 as seen along line 28—28 of FIG. 27 is illustrated.

As illustrated in FIGS. 26 through 28, in the lock section 330, a lock pin 332 is mounted to the base plate 312 via lock pin mounting member 500 which is mounted to the base plate 312. The lock pin 332 is provided so as to fittable into through holes 217 which are formed in the rail 216 within the range of movement of the raising/lowering stand 310 in left and right directions of the machine stand 12 along the rail 216. The through holes 217 are provided so as to prevent the movement of the proof unit 200 due to the engagement of the through hole 217 and the lock pin 332 at two positions: a predetermined position at which the proof unit 200 is positioned outside of the range of the surface of the platen glass 50, and at a predetermined position at which the proof unit 200 is disposed at a position opposing the surface of the platen glass 50. When the lock pin 332 is fit into the through hole 217, movement along the rail 216 of the base plate 312, i.e., the raising/lowering device 310, to which the lock pin 332 is attached is prevented so that the raising/lowering device 310 is held at a predetermined position.

A compression coil spring 334 is wound around a portion of the outer circumference of the lock pin 332 and usually urges the lock pin 332 in the direction of entering into the through hole 217.

A collar portion 336 is provided at a substantially intermediate portion of the lock pin 332 in the axial direction thereof. One end portion of a release plate 338 is fit between the collar portion 336 and the lock pin mounting member 500. A slit 340 and an inclined surface 342 are formed at the one end portion of the release plate 338. The lock pin 332 is fit into the slit 340 so as to be movable, and the collar portion 336 is engageable with the inclined surface 342. Namely, the release plate 338 moves and the inclined surface 342 pushes the collar portion 336 of the lock pin 332 against the urging force of the compression coil spring 334. Accordingly, the lock pin 332 can be separated from the rail 216 (i.e., from the through hole 217).

One end portion of a bell crank 344 is connected to the other end portion of the release plate 338. One end portion of an operation plate 346 is connected to the other end portion of the bell crank 344. A release lever 348 is mounted to the other end portion of the operation plate 346. Accordingly, by pushing the release lever 348 in the direction of arrow D in FIG. 28, the operation force is transferred to the release plate 338 via the operation plate 346 and the bell crank 344, and the release plate 338 is moved in the direction of arrow E.

A return spring 352 is attached between the other end portion of the bell crank 344 and a holding plate 350 which holds the operation plate 346. The return spring 352 usually urges in a direction in which the release plate 338 separates from the lock pin 332 (i.e., in the direction in which the inclined surface 342 separates from the collar portion 336).

On the other hand, as illustrated in FIGS. 20 through 22, feed screw shafts 354, 356, 358 are disposed at the longitudinal direction end portions and at the intermediate corner portion of the base plate 312 and the upper wall 316 between the base plate 312 and the upper wall 316 so that the axial directions thereof are substantially orthogonal to the respective surfaces. The upper and lower end portions of the feed screw shafts 354, 356, 358 are respectively supported by bearings 360 so as to rotate freely. Female screw blocks 362, 364, 366 are respectively screwed with the feed screw shafts 354, 356, 358. A raising/lowering plate 368, which is L-shaped when viewed from above, is fixed to the female screw blocks 362, 364, 366. Due to the rotation of the feed screw shafts 354, 356, 358, the female screw blocks 362, 364, 366 and the raising/lowering plate 368 fixed thereto are raised and lowered vertically.

As illustrated in FIGS. 20 through 22 and FIG. 25, the upper end portions of the feed screw shafts 354, 356, 358 protrude further upwardly than the upper wall 316, and pulleys 370, 372, 374 are respectively and coaxially connected and fixed thereto. Namely, the pulleys 370, 372, 374 are respectively fixed by bolts 380 to C-shaped lock blocks 378 which are connected and fixed so as to be fastened to the respective feed screw shafts 354, 356, 358 by bolts 376 positioned directly above the pulleys 370, 372, 374. Due to this structure, the respective pulleys 370, 372, 374 are integrally connected and fixed to the respective feed screw shafts 354, 356, 358 so as to always rotate integrally therewith.

A timing belt 382 is trained around the respective pulleys 370,372, 374. The timing belt 382 is endless, is trained around the respective pulleys 370, 372, 374, and is trained around a tension roller 384 disposed in a vicinity of the pulley 372. Due to this structure, the respective pulleys 370, 372, 374 are always rotated synchronously.

The tension roller 384 is fixed to the upper wall 316 by bolts 386. By changing the position at which the tension roller 384 is fixed, the tension of the timing belt 382 can be changed appropriately.

A rail 388 is disposed along the timing belt 382 at the side wall 314 which corresponds to the space between the pulley 372 and the pulley 374. A bracket 390 is provided at the rail 388. As illustrated in detail in FIGS. 23 through 25, rollers 392, 394, which are positioned at upper and lower sides of the rail 388, are mounted to the bracket 390 so as to nip the rail 388 from above and below. Accordingly, the bracket 390 is movable along the longitudinal direction of the rail 388. Further, an arm portion 396 extends from an upper end portion of the bracket 390. An end portion of the arm portion 396 is connected and fixed to the timing belt 382. Namely, when the bracket 390 moves along the rail 388, the timing belt 382 moves along with the movement of the bracket 390.

An operation knob 398 is fixed to the bracket 390. By operating the operation knob 398 so that the bracket 390 is moved along the rail 388, the timing belt 382 can be moved (rotated).

Figure 23:
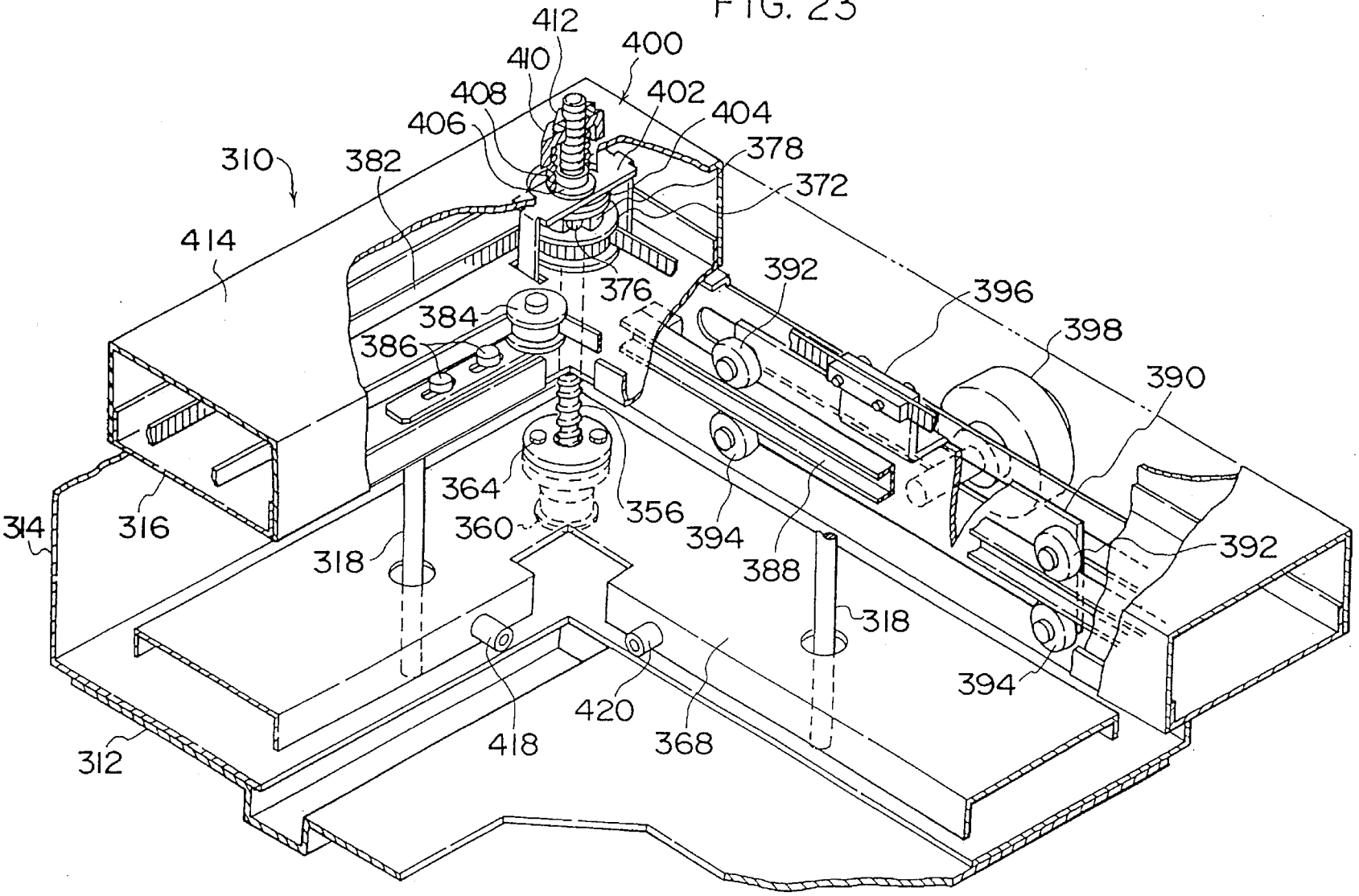
FIG. 23 is a perspective view illustrating details of an operation knob, a slip torque adjusting portion and peripheral parts of the raising/lowering device of the copying apparatus relating to the second embodiment of the present invention.
Figure 24:
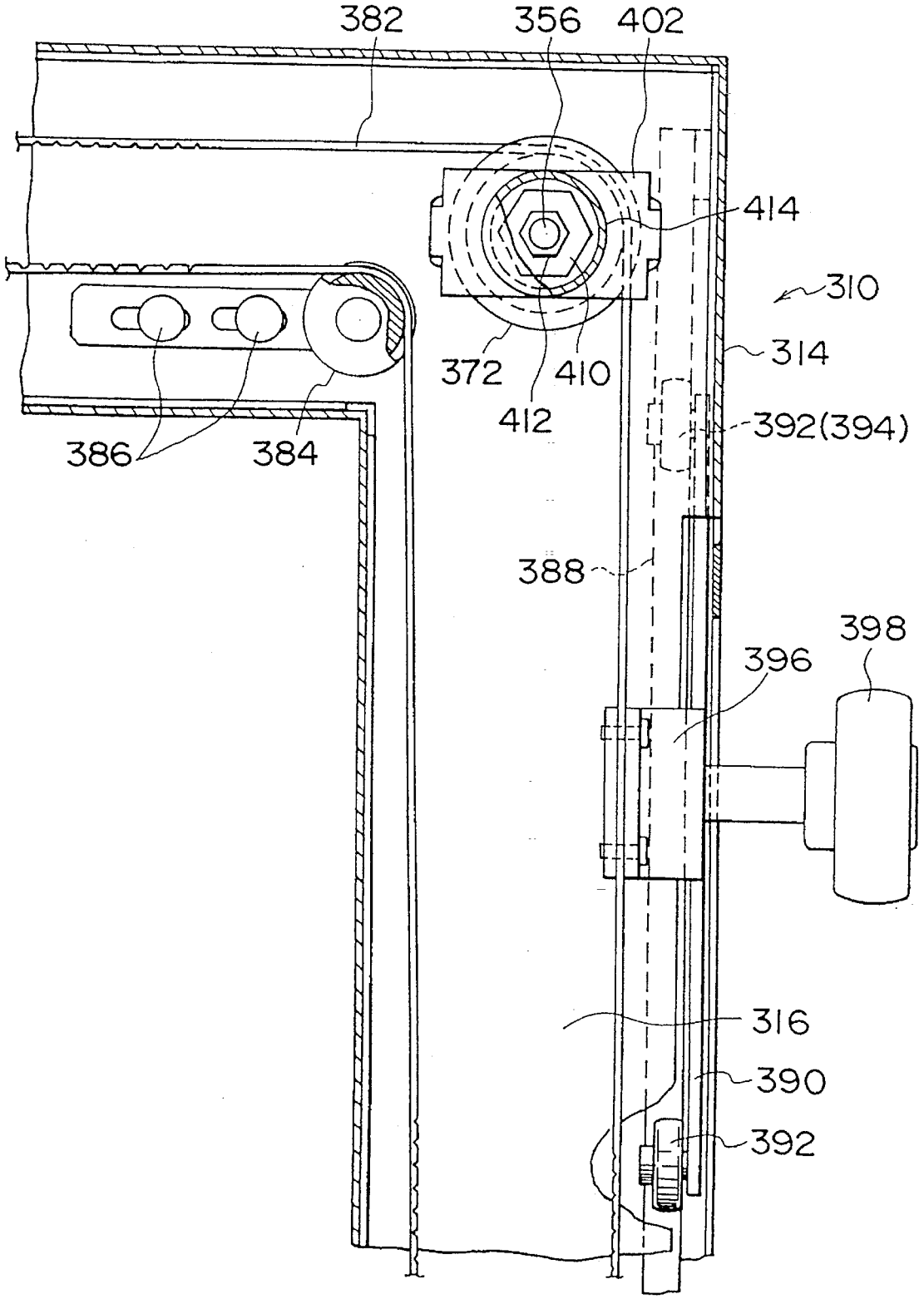
FIG. 24 is a transverse sectional view illustrating details of the operation knob, the slip torque adjusting portion and peripheral parts of the raising/lowering device of the copying apparatus relating to the second embodiment of the present invention.
Figure 25:
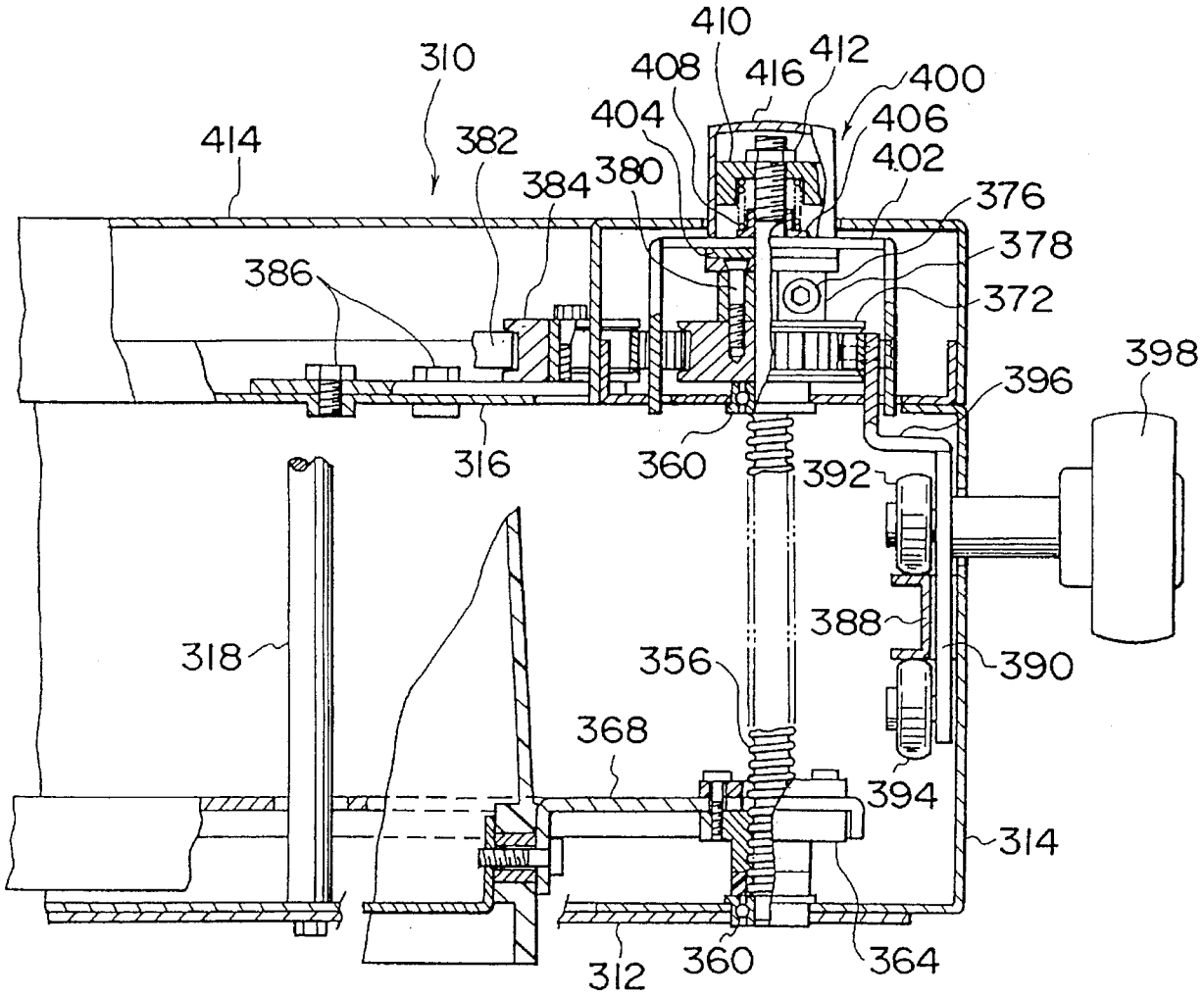
FIG. 25 is a vertical sectional view illustrating details of the operation knob, the slip torque adjusting portion and peripheral parts of the raising/lowering device of the copying apparatus relating to the second embodiment of the present invention.

As illustrated in detail in FIGS. 23 through 25, a slip torque adjusting portion 400 is provided above the C-shaped lock block 378 and at the upper end portion of the feed screw shaft 356 positioned at the longitudinal direction intermediate corner portion of the base plate 312 and the upper wall 316. At the slip torque adjusting portion 400, a friction plate 402 is provided at the periphery of the pulley 372. The friction plate 402 is formed in a substantially rectangular shape as viewed from the side surface, and is mounted to the upper wall 316 such that rotation of the friction plate 402 is prohibited. A brake shoe 404 is disposed between the friction plate 402 and the C-shaped lock block 378. The brake shoe 404 is formed by a plate material made of bakelite, and is disposed at the periphery of the feed screw shaft 356 so as to be able to rotate relatively to the feed screw shaft 356 and so as to be able to be pressed into contact with the friction plate 402.

A holding collar 406 and a compression coil spring 408 are disposed above the friction plate 402. Further, an adjusting nut 410 is screwed to the tip end of the feed screw shaft 356. The compression coil spring 408 is positioned between the holding collar 406 and the adjusting nut 410, and usually urges the holding collar 406 in the direction of the friction plate 402 (i.e., urges the brake shoe 404 in the direction of the friction plate 402). Accordingly, when the feed screw shaft 356 rotates, the rotation is restricted by the frictional force between the brake shoe 404 and the friction plate 402. Namely, by changing the screwed position of the adjusting nut 410 so as to change the urging force of the compression coil spring 408, the rotational force of the feed screw shaft 356 (the torque necessary for rotating the feed screw shafts 354, 356, 358 which are connected by the timing belt 382) can be set to a predetermined value.

A lock nut 412 screws with a portion of the feed screw shaft 356 above the adjusting nut 410. The lock nut 412 locks so that the screwed position of the adjusting nut 410 does not change unnecessarily due to the rotation of the feed screw shaft 356.

As illustrated in FIGS. 21 and 22, a cover 414 is attached to the upper wall 316 so that the pulleys 370, 372, 374, the timing belt 382 and the like are covered. Further, a cover 416 is attached to the slip torque adjusting portion 400 so that the adjusting nut 410 and the like are covered.

As in the first embodiment, among the surfaces of the proof unit 200 which are upright in the UP direction in FIG. 19, two adjacent surfaces are held, by the above-described raising/lowering device 310.

As illustrated in FIGS. 20 through 23, the rear surface side of the proof unit 200 (i.e., the surface in the REAR direction in FIG. 20) is connected and held by a pair of connecting pins 418 which project from the raising/lowering plate 368 which is raised and lowered by the rotation of the respective feed screw shafts 354, 356, 358. The right side surface of the proof unit 200 (i.e., the surface in the direction of arrow C in FIG. 20 which opposes the raising/lowering device 310) is connected and held by a pair of connecting pins 420 which project in the same way from the raising/lowering plate 368.

Accordingly, as in the previously-described first embodiment, the proof unit 200 moves together with the raising/lowering device 310 in left and right directions (the directions of arrow C) of the machine stand 12 so as to be positioned at and separated from a position opposing the surface of the platen glass 50. Further, the proof unit 200 is structured so as to move upwardly and downwardly together with the raising/lowering plate 368 of the raising/lowering device 310.

Operation of the second embodiment will now be described.

In the copying apparatus 300 relating to the second embodiment, when an ordinary original is to be copied, a transparency original is to be copied or a three-dimensional object is to be copied, the fundamental copy operations of the respective portions of the apparatus are tile same as those in the first embodiment. As only the raising/lowering operation (mechanism) of the proof unit 200 by the raising/lowering device 310 is different, the raising/lowering operation will be described in detail.

When, for example, a three-dimensional object is to be copied by the copying apparatus 300, the light source 40 of the exposure device 38 and the proof unit 200 are operated.

Namely, the raising/lowering device 310 which holds the proof unit 200 is operated and moves along the rail 216 toward the left of the machine stand 12 so as to be positioned at a position corresponding to the surface of the platen glass 50.

Figure 29:
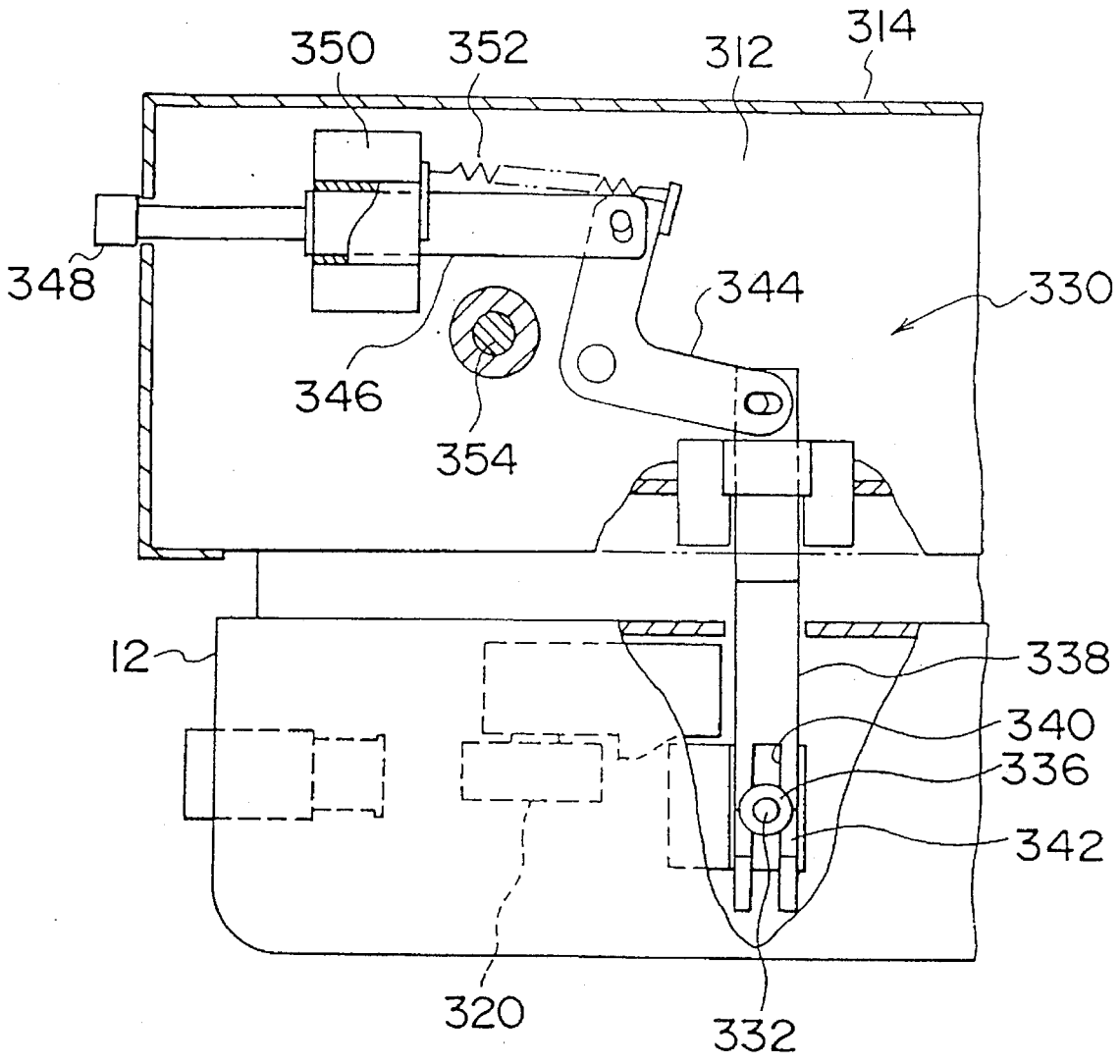
FIG. 29 is a plan view corresponding to FIG. 28 and illustrating an operated state of the lock portion of the raising/lowering device of the copying apparatus relating to the second embodiment of the present invention.

In this case, due to the operation (i.e., the pushing in) of the release lever 348 provided at the lock portion 330 of the raising/lowering device 310, the release plate 338 is moved via the operation plate 346 and the bell crank 344 as illustrated in FIG. 29. The inclined surface 342 pushes the collar portion 336 of the lock pin 332, and the lock pin 332 is removed from the rail 216 (i.e., the through hole 217). Accordingly, the raising/lowering device 310 (more specifically, the base plate 312), that is, the proof unit 200, can move along the longitudinal direction of the rail 216. By releasing the operation of the release lever 348 after the proof unit 200 is positioned at the position opposing the surface of the platen glass 50, the release plate 338 and the like return to their original positions due to the urging force of the return spring 352, and the lock pin 332 is inserted into the through hole 217 due to the urging force of the compression coil spring 334 so that movement of the raising/lowering device 310, i.e., the proof unit 200, along the rail 216 is prevented and the raising/lowering device 310 is held at a predetermined position (the state illustrated in FIGS. 26 through 28).

Next, the operation knob 398 of the raising/lowering device 310 is operated so that the bracket 390 is moved along the rail 388. Simultaneously, the timing belt 382 which is fixed to the bracket 390 via the arm portion 396 is moved (rotated). In this way, the pulleys 370, 372, 374, around which the timing belt 382 is trained, are rotated synchronously with the movement of the bracket 390. The feed screw shafts 354, 356, 358, which are connected and fixed to the pulleys 370, 372, 374, are rotated synchronously with the rotation of the pulleys 370, 372, 374. When the feed screw shafts 354, 356, 358 rotate, the female screw blocks 362, 364, 368, which are screwed to the feed screw shafts 354, 356, 358, and the raising/lowering plate 368, which is fixed to the female screw blocks 362, 364, 368, are raised along the axial lines of the feed screw shafts 354, 356, 358. Accordingly, the proof unit 200 connected to the raising/lowering plate 368 is raised and is held in a state in which it is separated from the platen glass 50 by a predetermined distance (e.g., 70 mm).

In this case, at the raising/lowering device 310 of the copying apparatus 300, the raising/lowering plate 368, which holds the rear surface side and the right surface side of the proof unit 200, is held by the feed screw shafts 354, 356, 358. The operational force of the operation knob is transmitted equally to the respective feed screw shafts 354, 356, 358 by the timing belt 382. In other words, the operational force of the operation knob 398 is applied uniformly to the load of the proof unit 200 which acts on the raising/lowering plate 368 (i.e., the feed screw shafts 354, 356, 358). As a result, the raising/lowering plate 368, i.e., the proof unit 200, is raised and lowered smoothly.

In the state in which the proof unit 200 is separated from the platen glass 50 in an upward direction, the proof unit 200 and the raising/lowering device 310 are held by the holders 326 positioned within the rail 216. Therefore, the proof unit 200 does not lean unnecessarily toward the front surface side of the machine stand 12 (toward the operation panel 180).

Further, the slip torque adjusting portion 400 is provided at the upper end portion of the feed screw shaft 356. By changing the screwed position of the adjusting nut 410 so as to change the urging force of the compression coil spring 408, the rotational force of the feed screw shaft 356 (i.e., the torque necessary to rotate the feed screw shafts 354, 356, 358 which are connected by the timing belt 382) can be set to a predetermined value. Therefore, the operational force of tile operation knob 398 can be set as desired in accordance with the operator's wishes. Further, by setting the rotational force of the feed screw shaft 356 (i.e., the torque necessary for rotation) in accordance with the load of the proof unit 200, the raising/lowering plate 368, i.e, the proof unit 200, can be prevented from descending unnecessarily, and the predetermined position thereof can easily be maintained.

Next, description will be given of a case in which a three-dimensional object, which is an object to be copied, is inserted between the proof unit 200 and the platen glass 50 and is placed on the platen glass 50. In this case as well, only the rear side surface and the right side surface of the proof unit 200 are held by the raising/lowering device 310 (the raising/lowering plate 368). In other words, there are no covers at the front side surface and the left side surface of the proof unit 200, and the space between the proof unit 200 and the platen glass 50 is sufficiently open. Therefore, when a three-dimensional object to be copied is inserted between the proof unit 200 and the platen glass 50, there are no obstructions, and the three-dimensional object can be easily inserted and disposed therebetween.

After the three-dimensional object to be copied has been disposed on the platen glass 50, in the same way as in the first embodiment, the exposure device 38 is operated, and light from the light source 40 is illuminated successively onto the three-dimensional object disposed on the platen glass 50. Simultaneously, the lamp unit 244 (i.e., the light source 270) and the motor 268 of the proof unit 200 are operated synchronously with the exposure device 38. Light is successively and synchronously illuminated in a slit shape by the proof unit 200 to the back surface of the three-dimensional object disposed on the platen glass 50.

Accordingly, the image light reflected from the three-dimensional object is scanned and exposed onto the photosensitive material 16 positioned at the exposure section 22, and the light transmitted through the background portions of the three-dimensional object is scanned and exposed onto the photosensitive material 16 positioned at the exposure section 22. In this way, an image of the three-dimensional object positioned on the platen glass 50 is recorded, and the background image thereof is recorded in white.

In the copying apparatus 300 relating to the second embodiment as well, when a three-dimensional object is copied, the background of the copied object is not black on the recorded image. Further, no irregular shadows caused by covering the three-dimensional object disposed on the platen glass 50 with a cloth or the like are recorded. Therefore, an extremely high-quality image is obtained. Further, the background image of the copied three-dimensional object can be exposed and recorded at any desired color in addition to white.

In the copying apparatus 300, in the same way as in the first embodiment, by using the white boards 218, 220, supplemental image information such as the name of the copied three-dimensional object, the date and the like can be recorded. Further, if, for example, a scale, a color chart, a name plate or the like is used instead of the white boards 218, 220, various types of supplemental image information corresponding to the recorded image can easily be recorded. Moreover, vignetting which occurs when a three-dimensional object is copied can be prevented, and portions in which vignetting occurs can be effectively utilized.

In the first and the second embodiments, the proof unit 200 is held by the pantograph 202 and the pantograph 204 serving as a holding means or by the raising/lowering device 310 serving as a holding means. While inclination of the proof unit 200 is prevented by the holders 234 or by the holders 326, the proof unit 200 is moved along the rail 216 in left and right directions of the machine stand 12 so as to be able to be positioned at or separated from a position corresponding to the surface of the platen glass 50. However, the present invention is not limited to the same. Other structures are also applicable as long as the proof unit 200 can be held in a state in which it is separated in an upward direction from the surface of the platen glass 50 by a predetermined distance when the proof unit 200 has been moved to the position opposing the surface of the platen glass 50.

For example, instead of the pantographs 202, 204 and the raising/lowering device 310, a supporting stand which supports the proof unit may be provided at the upper surface of the machine stand 12. Hinges may be provided at a portion of the supporting stand such that the proof unit 200 is connected to and supported at the supporting stand via the hinges. By pivoting the proof unit 20 around the hinges, the proof unit 200 can be positioned at or separated from a position opposing to the surface of the platen glass 50.

Further, in the first and the second embodiments, the proof unit 200 is held by the pantographs 202, 204 or by the raising/lowering device 310 at two places: the rear surface side (the side opposing the operation panel 180) and the right surface side. However, a structure may be employed in which the left side surface is held in place of the right side surface as long as there are no obstacles to the movement of the proof unit 200 (e.g., as long as no other parts are obstructive). In this case as well, the space between the platen glass 50, on the one hand, and the front side surface and the right side surface, on the other hand, is sufficiently open. Therefore, there are no obstacles to the insertion of the three-dimensional object to be copied between the proof unit 200 and the platen glass 50, and a three-dimensional object can easily be inserted and disposed therebetween.

Further, in both of the above-described embodiments, in the proof unit 200, the amount of illuminated light and the color of the illuminated light are changed by the ND filter 272 and the color correcting filter 274 of the lamp unit 244 which is incorporated in the proof unit 200. However, the present invention is not limited to the same, and another means may be used. For example, by changing the position (height) at which the proof unit 200 itself is held, the amount of illuminated light may be changed. Alternatively, the voltage of the light source 270 may be changed so that the amount of illuminated light is changed. In addition, by changing the light source 270 itself, the amount of the illuminated light may be changed. By using another light filter, the amount of light and the color can be changed.

Moreover, in both of the above-described embodiments, images are recorded at the copying apparatuses 10, 300 equipped with the proof unit 200 by using the photosensitive material 16 and the image receiving material 108 as image recording materials. However, the present invention is not limited to the same and is applicable to other copying apparatuses in which copying is effected by using other image recording materials.

What is claimed is:

1. A copying apparatus for the photographic reproduction of a multi-dimensional object capable of photocopying an original and a three-dimensional object, comprising:

a platen glass on which one of said original and said three-dimensional object is disposed to cover a primary portion of said platen glass, uncovered portion of said platen glass corresponding background portions;

a primary light source disposed such that said platen glass is disposed between said primary light source and said one of said original and said three-dimensional object, said primary light source emitting a primary light representative of an image which is reflected by said one of said original and said three-dimensional object;

an exposure section for receiving said reflected light and for exposing a photosensitive material to form the image thereon; and a secondary light sources for illuminating a secondary light through said uncovered portions of said one of said original and said three-dimensional object, said secondary light source being disposed so as to be separated from a surface of said platen glass in a vertical direction and being disposed such that said one of said original and said three-dimensional object is positioned between said secondary light source and said platen glass, wherein said secondary light is received by said exposure section and said photosensitive material is exposed thereby.

2. A copying apparatus according to claim 1, wherein said secondary light source can also illuminate a transparency original which is disposed on said platen glass, said transparency original being copied by light being transmitted therethrough.

3. A copying apparatus according to claim 1, wherein said secondary light source has a light amount changing means for changing an amount of light illuminated to said three-dimensional object.

4. A copying apparatus according to claim 1, wherein said secondary light source has a color correction means for changing a color of light illuminated to said three-dimensional object.

5. A copying apparatus according to claim 2, wherein said secondary light source has a light amount changing means for changing an amount of light illuminated to said transparency original.

6. A copying apparatus according to claim 2, wherein said secondary light source has a color correction means for changing a color of light illuminated to said transparency original.

7. A copying apparatus able to copy an original and a three-dimensional object, comprising:

a platen glass on which one of said original and said three-dimensional object is disposed;

a light source disposed such that said platen glass is disposed between said light source and said one of said original and said three-dimensional object, said light source successively illuminating copy light in a slit shape to said one of said original and said three-dimensional object via said platen glass so that the copy light illuminated to said one of said original and said three-dimensional object is reflected by said one of said original and said three-dimensional object and exposed onto a photosensitive material;

illuminating means for illuminating said one of said original and said three-dimensional object, said illuminating means source being provided so as to be able to be positioned within and separate from a region opposing a surface of said platen glass, and when said illuminating means is positioned within the region, said illuminating means is disposed such that said one of said original and said three-dimensional object is positioned between said platen glass and said illuminating means, and said illuminating means is operated synchronously with said light source and has a linear light source for generating light in a slit shape and successively illuminates said light of said linear light source to said one of said original and said three-dimensional object; and holding means for holding said illuminating means in a state in which said illuminating means is separated from the surface of said platen glass by a predetermined distance in a substantially vertical direction, when said illuminating means is disposed within the region opposing the surface of said platen glass.

8. A copying apparatus according to claim 7, wherein said holding means are plurally provided and placed at positions to avoid contact between said holding means and said one of said original and said three-dimensional object when said illuminating means moves from a state of being disposed within the region opposing the surface of said platen glass, and to facilitate placement of said one of said original and said three-dimensional object on said platen glass when said illuminating means is disposed within the region opposing the surface of said platen glass.

9. A copying apparatus according to claim 7, wherein said illuminating means has a light amount changing means for changing an amount of light illuminated to said one of said original and said three-dimensional object.

10. A copying apparatus according to claim 7, wherein said illuminating means has a color correction means for changing a color of light illuminated to said one of said original and said three-dimensional object.

11. A copying apparatus according to claim 8, wherein said illuminating means has a light amount changing means for changing an amount of light illuminated to said one of said original and said three-dimensional object.

12. A copying apparatus according to claim 8, wherein said illuminating means has a color correction means for changing a color of light illuminated to said one of said original and said three-dimensional object.

13. A copying apparatus according to claim 7, further comprising:

a supplemental information recording member, when said illuminating means is in an operating state in which said illuminating means illuminates said one of said original and said three-dimensional object and at all holding positions at which said illuminating means is held by said holding means so as to be separated from the surface of said platen glass, said supplemental information recording member is provided at a predetermined position on the surface of said platen glass and supplemental image information is recorded on a surface of said supplemental information recording member opposing the surface of said platen glass, and said supplemental image information is recorded onto an image recording material by copy light illuminated from said light source being reflected by said supplemental information recording member.

14. A copying apparatus according to claim 8, further comprising:

a supplemental information recording member, when said illuminating means is in an operating state in which said illuminating means illuminates said one of said original and said three-dimensional object and at all holding positions at which said illuminating means is held by said holding means so as to be separated from the surface of said platen glass, said supplemental information recording member is provided at a predetermined position on the surface of said platen glass and supplemental image information is recorded on a surface of said supplemental information recording member opposing the surface of said platen glass, and said supplemental image information is recorded onto an image recording material by copy light illuminated from said light source being reflected by said supplemental information recording member.

15. A copying apparatus according to claim 9, further comprising:

a supplemental information recording member, when said illuminating means is in an operating state in which said illuminating means illuminates said one of said original and said three-dimensional object and at all holding positions at which said illuminating means is held by said holding means so as to be separated from the surface of said platen glass, said supplemental information recording member is provided at a predetermined position on the surface of said platen glass and supplemental image information is recorded on a surface of said supplemental information recording member opposing the surface of said platen glass, and said supplemental image information is recorded onto an image recording material by copy light illuminated from said light source being reflected by said supplemental information recording member.

16. A copying apparatus according to claim 10, further comprising:

a supplemental information recording member, when said illuminating means is in an operating state in which said illuminating means illuminates said one of said original and said three-dimensional object and at all holding positions at which said illuminating means is held by said holding means so as to be separated from the surface of said platen glass, said supplemental information recording member is provided at a predetermined position on the surface of said platen glass and supplemental image information is recorded on a surface of said supplemental information recording member opposing the surface of said platen glass, and said supplemental image information is recorded onto an image recording material by copy light illuminated from said light source being reflected by said supplemental information recording member.

17. A copying apparatus according to claim 11, further comprising:

a supplemental information recording member, when said illuminating means is in an operating state in which said illuminating means illuminates said one of said original and said three-dimensional object and at all holding positions at which said illuminating means is held by said holding means so as to be separated from the surface of said platen glass, said supplemental information recording member is provided at a predetermined position on the surface of said platen glass and supplemental image information is recorded on a surface of said supplemental information recording member opposing the surface of said platen glass, and said supplemental image information is recorded onto an image recording material by copy light illuminated from said light source being reflected by said supplemental information recording member.

18. A copying apparatus according to claim 12, further comprising:

a supplemental information recording member, when said illuminating means is in an operating state in which said illuminating means illuminates said one of said original and said three-dimensional object and at all holding positions at which said illuminating means is held by said holding means so as to be separated from the surface of said platen glass, said supplemental information recording member is provided at a predetermined position on the surface of said platen glass and supplemental image information is recorded on a surface of said supplemental information recording member opposing the surface of said platen glass, and said supplemental image information is recorded onto an image recording material by copy light illuminated from said light source being reflected by said supplemental information recording member.

19. A copying apparatus according to claim 7, wherein said holding means is a pantograph structure member in which a plurality of elongated plate members are formed in a pantograph configuration.

20. A copying apparatus according to claim 7, wherein said holding means has a raising and lowering member, which is connected to said illuminating means and which moves said illuminating means from the surface of said platen glass in a substantially vertical direction, and has a driving means for moving said raising and lowering member from the surface of said platen glass in a substantially vertical direction.

21. A copying apparatus able to copy an original and a three-dimensional object, comprising:

a platen glass on which one of said original and said three-dimensional object is disposed; and illuminating means for illuminating light to said one of said original and said three-dimensional object, said illuminating means being disposed so as to be separated from a surface of said platen glass by a predetermined distance in a vertical direction and being disposed such that said one of said original and said three-dimensional object is positioned between said illuminating means and said platen glass, wherein said illuminating means has a color correction means for changing a color of light illuminated to said three-dimensional object.

22. A copying apparatus able to copy an original and a three-dimensional object, comprising:

a platen glass on which one of said original and said three-dimensional object is disposed; and illuminating means for illuminating light to said one of said original and said three-dimensional object, said illuminating means being disposed so as to be separated from a surface of said platen glass by a predetermined distance in a vertical direction and being disposed such that said one of said original and said three-dimensional object is positioned between said illuminating means and said platen glass, wherein said illuminating means can also illuminate a transparency original which is disposed on said platen glass, and said transparency original being copied by light being transmitted therethrough, wherein said illuminating means has a color correction means for changing a color of light illuminated to said transparency original.

* * * * *